US010737134B2

(12) United States Patent
Anderson et al.

(10) Patent No.: US 10,737,134 B2
(45) Date of Patent: Aug. 11, 2020

(54) WALL-MOUNTED COLLAPSIBLE EXERCISE SYSTEM

(71) Applicant: PRx Performance, LLC, Fargo, ND (US)

(72) Inventors: Brandon V. Anderson, Moorhead, MN (US); Devin M. Pace, Denver, CO (US)

(73) Assignee: PRx Performance, LLC, Fargo, ND (US)

( * ) Notice: Subject to any disclaimer, the term of this patent is extended or adjusted under 35 U.S.C. 154(b) by 22 days.

(21) Appl. No.: 16/189,707

(22) Filed: Nov. 13, 2018

(65) Prior Publication Data

US 2020/0147445 A1 May 14, 2020

(51) Int. Cl.
*A63B 21/00* (2006.01)
*A63B 23/02* (2006.01)

(52) U.S. Cl.
CPC .... *A63B 21/4029* (2015.10); *A63B 21/00047* (2013.01); *A63B 21/4034* (2015.10); *A63B 23/0211* (2013.01); *A63B 23/0216* (2013.01); *A63B 2208/0242* (2013.01); *A63B 2210/50* (2013.01)

(58) Field of Classification Search
CPC ..... A63B 21/4029; A63B 2210/50–58; A63B 21/078; A63B 23/0211; A63B 21/00047; A63B 23/0216; A63B 21/4034; A63B 2208/0242
See application file for complete search history.

(56) References Cited

U.S. PATENT DOCUMENTS 1,104,505 A 7/1914 Holworthy
1,776,204 A * 9/1930 Tascarella ..... A61G 13/105 5/613

(Continued)

FOREIGN PATENT DOCUMENTS

DE 4307632 A1 9/1993
GB 2076299 A 12/1981

OTHER PUBLICATIONS http://www.roguefitness.com:80/dirty-south-bar.php; Rogue Fitness Dirty South Bar Website Page; Jan. 23, 2013.

(Continued)

*Primary Examiner* — Nyca T Nguyen
(74) *Attorney, Agent, or Firm* — Neustel Law Offices

(57) ABSTRACT

A wall-mounted collapsible exercise system which is adjustable between a collapsed position against a wall and an expanded position for use in multiple exercise configurations. The wall-mounted collapsible exercise system generally includes a mount support adapted to be connected to a wall, a body support adapted to support an exerciser, and a base support adapted to support the body support when the body support is in use. The body support may be pivotably connected to the mount support and the base support may be pivotably connected to the body support such that the body support and base support are adjustable between a first collapsed position for storage and a second expanded position for use. When in the expanded position, the body support may be converted between a glute ham developer configuration and a reverse hyper configuration through use of various exercise attachments.

21 Claims, 20 Drawing Sheets

(56) References Cited

U.S. PATENT DOCUMENTS 2,855,200 A * 10/1958 Blickman ..... A63B 21/154 482/130
3,218,070 A * 11/1965 Crowther ..... A63B 69/345 473/441
3,614,097 A 10/1971 Blickman
3,741,538 A * 6/1973 Lewis ..... A63B 17/00 482/120
3,874,657 A * 4/1975 Niebojewski ..... A63B 17/00 482/104
3,918,710 A 11/1975 Niebojewski
4,249,726 A 2/1981 Faust
4,257,590 A 3/1981 Sullivan
4,262,901 A 4/1981 Faust
4,286,782 A 9/1981 Fuhrhop
4,306,715 A 12/1981 Sutherland
4,358,109 A 11/1982 Schrems
4,368,884 A 1/1983 Colvin
4,369,966 A 1/1983 Silberman
4,396,191 A 8/1983 Metler
4,431,181 A * 2/1984 Baswell ..... A63B 21/154 482/102
4,527,797 A 7/1985 Slade, Jr.
4,603,855 A 8/1986 Sebelle
4,615,524 A 10/1986 Sutherland
4,621,809 A 11/1986 Pearl
4,624,457 A * 11/1986 Silberman ..... A63B 23/03525 482/98
4,635,934 A 1/1987 Roethke
4,637,608 A 1/1987 Owens
4,645,196 A 2/1987 Christie
4,650,186 A 3/1987 McCreery
4,729,561 A 3/1988 Desjardins
4,757,998 A 7/1988 Landin
4,765,616 A 8/1988 Wolff
4,773,642 A 9/1988 Cruz
4,781,374 A 11/1988 Lederman
4,795,149 A 1/1989 Pearson
4,801,139 A * 1/1989 Vanhoutte ..... A63B 21/0083 482/112
4,804,179 A 2/1989 Murphy
4,826,153 A 5/1989 Schalip
4,842,270 A 6/1989 Lange
4,844,448 A 7/1989 Niznik
4,861,024 A 8/1989 Lee
4,861,025 A 8/1989 Rockwell
4,898,381 A 2/1990 Gordon
4,907,798 A 3/1990 Burchatz
4,915,377 A 4/1990 Malnke
4,919,419 A 4/1990 Houston
4,927,135 A * 5/1990 Nieppola ..... A63B 21/169 482/41
4,928,961 A 5/1990 Madden
4,934,693 A 6/1990 Santoro
4,936,572 A 6/1990 Desiderio
4,955,604 A 9/1990 Pogue
4,958,833 A 9/1990 Stater
4,960,277 A 10/1990 LaRossa
4,974,837 A 12/1990 Someya
4,976,428 A 12/1990 Ghazi
5,011,141 A 4/1991 Towley, III
5,046,722 A * 9/1991 Antoon ..... A63B 17/00 482/39
5,082,259 A 1/1992 Gonzalez
5,082,260 A 1/1992 Dinelli
5,094,445 A * 3/1992 Winkelvoss ..... A61H 1/0229 482/111
5,098,361 A 3/1992 Danylieko
5,141,480 A 8/1992 Lennox
5,151,072 A 9/1992 Cone
5,184,992 A 2/1993 Banks
5,242,345 A 9/1993 Mitchell
5,249,858 A 10/1993 Nusser
5,281,193 A 1/1994 Colbo, Jr.
5,306,220 A 4/1994 Kearney
5,328,428 A 7/1994 Huang
5,346,448 A 9/1994 Sollo
5,350,346 A 9/1994 Martinez
5,356,359 A * 10/1994 Simmons ..... A63B 21/0615 482/137
5,456,644 A 10/1995 Hecox
5,466,204 A 11/1995 Nearing
5,509,876 A 4/1996 Reyes
5,551,936 A 9/1996 Parisi
5,562,579 A * 10/1996 Sheikowitz ..... A63B 21/0615 482/104
5,669,859 A 9/1997 Liggett
5,688,216 A 11/1997 Mauriello
D390,287 S 2/1998 Hsieh
5,725,459 A * 3/1998 Rexach ..... A63B 23/1209 482/92
5,755,823 A 5/1998 Cleary
5,779,601 A 7/1998 Ish, III
5,813,951 A 9/1998 Einsig
5,882,283 A 3/1999 Stevens
5,921,897 A 7/1999 Stevens
5,971,897 A 10/1999 Olson
6,027,433 A 2/2000 Flynn
6,073,624 A 6/2000 Laurent
6,090,021 A * 7/2000 Flowers ..... A63B 21/078 482/104
6,248,048 B1 6/2001 Zuckerman
6,299,568 B1 10/2001 Prok
6,328,679 B1 12/2001 Croft
6,443,877 B1 9/2002 Hoecht
6,454,683 B1 * 9/2002 Kaye ..... A47B 83/045 482/142
6,482,139 B1 * 11/2002 Haag ..... A63B 21/0552 482/121
6,491,607 B2 * 12/2002 Simmons ..... A63B 23/0233 482/93
6,579,213 B1 6/2003 Webber
6,685,601 B1 2/2004 Knapp
7,070,546 B1 7/2006 Grasso
7,338,416 B2 3/2008 Smith
7,374,516 B2 5/2008 Lundquist
7,393,309 B2 7/2008 Webber
7,435,207 B2 * 10/2008 Cook ..... A63B 21/0615 297/58
7,455,621 B1 11/2008 Anthony
7,473,212 B2 * 1/2009 Simmons ..... A63B 23/0233 482/137
7,488,277 B1 * 2/2009 Knapp ..... A63B 21/078 482/104
7,549,950 B1 6/2009 Lundquist
7,575,538 B1 * 8/2009 Clark ..... A63B 21/154 482/103
7,635,322 B2 12/2009 Parrilla
7,666,118 B1 2/2010 Anthony
7,699,756 B2 4/2010 Piane, Jr.
8,047,972 B1 11/2011 Dean
8,231,509 B2 7/2012 Lundquist
8,491,449 B2 7/2013 Rogers
8,506,459 B2 * 8/2013 Cassidy ..... A63B 21/156 482/102
8,517,900 B1 8/2013 Britt
8,529,413 B2 * 9/2013 Simmons ..... A63B 21/0615 482/100
8,632,444 B2 * 1/2014 McBride ..... A63B 21/023 482/121
8,727,953 B2 5/2014 Drechsler
9,333,387 B2 * 5/2016 Hopperstad ..... A63B 21/078
9,375,599 B1 * 6/2016 Simmons ..... A63B 21/00181
9,409,048 B1 * 8/2016 Hopperstad ..... A63B 21/078
9,744,400 B2 * 8/2017 Cole ..... A63B 22/0089
2002/0091043 A1 * 7/2002 Rexach ..... A63B 21/0628 482/98
2004/0092369 A1 5/2004 Slawinski
2005/0248204 A1 * 11/2005 Berg ..... A47C 7/36 297/452.11
2008/0248935 A1 * 10/2008 Solow ..... A63B 21/023 482/142
2008/0276551 A1 11/2008 Thomas

(56) References Cited

U.S. PATENT DOCUMENTS

| | | | | |
|---|---|---|---|---|
| 2009/0143203 | A1* | 6/2009 | Knapp | A63B 21/078 482/104 |
| 2009/0289535 | A1 | 11/2009 | Weber | |
| 2012/0165168 | A1* | 6/2012 | Simmons | A63B 21/0615 482/139 |
| 2012/0289384 | A1 | 11/2012 | Staten | |
| 2013/0257242 | A1 | 10/2013 | Bunch | |
| 2014/0213414 | A1* | 7/2014 | Balandis | A63B 24/0087 482/5 |
| 2014/0243174 | A1* | 8/2014 | Alenaddaf | A63B 71/0036 482/142 |
| 2014/0339184 | A1* | 11/2014 | Couch | A47B 46/005 211/85.11 |
| 2015/0148197 | A1 | 5/2015 | Lentz | |
| 2015/0157892 | A1* | 6/2015 | Johnson | A63B 22/20 482/94 |
| 2015/0290488 | A1* | 10/2015 | Hopperstad | A63B 21/078 482/38 |
| 2016/0016033 | A1 | 1/2016 | Schrag | |
| 2016/0096062 | A1* | 4/2016 | Moerth-Cross | A61G 13/105 482/101 |
| 2016/0271444 | A1* | 9/2016 | Payne | A63B 23/1236 |
| 2017/0209733 | A1* | 7/2017 | Beaver | A63B 21/169 |
| 2017/0239512 | A1* | 8/2017 | Brasch | A63B 21/4029 |

OTHER PUBLICATIONS http://www.roguefitness.com:80/bodyweight-gymnastics/rpg-pullup-system.php; Rogue Fitness Pull Up & RPG Systems Website Page; Jan. 23, 2013.

http://www.roguefitness.com:80/rogue-r-3-power-rack.php; Rogue Fitness R3 Power Rack Website Page; Jan. 11, 2013.

http://www.roguefitness.com:80/rogue-sm-2-monster-squat-stand.php; Rogue Fitness SM-2 Monster Squat Stand Website Page; Jan. 27, 2013.

http://www.roguefitness.com:80/w4-garage-gym.php; Rogue Fitness W-4 Garage Gym Website Page; Jan. 23, 2013.

http://www.roguefitness.com:80/x-43m-multi-grip-crossmember.php; Rogue Fitness X-43 Multi-Grip Crossmember Website Page; Jan. 23, 2013.

http://www.roguefitness.com/rogue-4-monster-lite-wall-mount, Monster Lite Wall Mount Webpage from Rogue Fitness; Jan. 1, 2014.

http://board.crossfit.com/showthread.php?t=86058; Website for Crossfit Message Board; Feb. 8, 2014.

http://board.crossfit.com/showthread.php?t=86058; Pictures from Website for Crossfit Message Board; Feb. 8, 2014.

Pictures of PRX Performance Pull-Up Bar on Central Rig Display at Granite Games; Oct. 5, 2013.

https://www.youtube.com/watch?v=f6bPYbS_2Fw; YouTube Video Equipment Demo Rogue Dirty South Bar; Apr. 26, 2012.

https://www.youtube.com/watch?v=koAzH91o474; YouTube Video Matt Chan Talks the Dirty South Bar; Dec. 20, 2012.

2717 Equipment Facebook Posts—Wall Mounted Pull Up and Squat Rack; Mar. 27, 2012.

2717 Equipment Facebook Posts—W-1 Pull Up and Rack; Nov. 8, 2012.

https://www.titan.fitness/hpnd1-hpnd2.html?gclid=EAlalQobChMlz4Dd95HD3glVB9bACh2xlQxvEAQYASABEgKzbvD_BwE; Titan Fitness H-PND Equipment Webpage and Pictures; Nov. 13, 2018.

https://www.roguefitness.com/rogue-gh-1-ghd?prod_id=40507&gclid=EAlalQobChMlrufx15HD3gIVILXACh1kOgWlEAQYASABEgKVmvD_BwE; Rogue GH-1 GHD Webpage and Pictures; Nov. 13, 2018.

* cited by examiner

WALL-MOUNTED COLLAPSIBLE EXERCISE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a wall-mounted collapsible exercise system which is adjustable between a collapsed position against a wall and an expanded position for use in multiple exercise configurations.

Related Art

Any discussion of the related art throughout the specification should in no way be considered as an admission that such related art is widely known or forms part of common general knowledge in the field.

Exercise machines have been in use for many years. In present times, it is common to have a home exercise room or gym to avoid having to go to a fitness center or the like to work out. However, exercise machines tend to take up a large amount of space, which can limit the number of exercise machines which fit into such a home gym. Further, in commercial fitness studios, bulky exercise machines can reduce the number of options offered to customers.

Exercise machines such as glute ham developers (GHD) and reverse hyper extension machines (reverse hyper) are commonly used in commercial fitness studios. While such exercise machines have been desired for use in home gyms, they are often omitted due to space constraints. These particular exercise machines can be extremely bulky, heavy, and take up a lot of floor space. While collapsible exercise machines have been offered, such machines are typically not wall-mounted and are difficult to maneuver. Further, such exercise machines typically are limited in the exercises being offered. For example, they could not be used both as a GHD machine and a reverse hyper machine.

SUMMARY

An example embodiment is directed to a wall-mounted collapsible exercise system. The wall-mounted collapsible exercise system includes a mount support adapted to be connected to a wall, a body support adapted to support an exerciser, and a base support adapted to support the body support when the body support is in use. The body support may be pivotably connected to the mount support and the base support may be pivotably connected to the body support such that the body support and base support are adjustable between a first collapsed position for storage and a second expanded position for use. When in the expanded position, the body support may be converted between a glute ham developer configuration and a reverse hyper configuration through use of various exercise attachments.

There has thus been outlined, rather broadly, some of the embodiments of the wall-mounted collapsible exercise system in order that the detailed description thereof may be better understood, and in order that the present contribution to the art may be better appreciated. There are additional embodiments of the wall-mounted collapsible exercise system that will be described hereinafter and that will form the subject matter of the claims appended hereto. In this respect, before explaining at least one embodiment of the wall-mounted collapsible exercise system in detail, it is to be understood that the wall-mounted collapsible exercise system is not limited in its application to the details of construction or to the arrangements of the components set forth in the following description or illustrated in the drawings. The wall-mounted collapsible exercise system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1B:
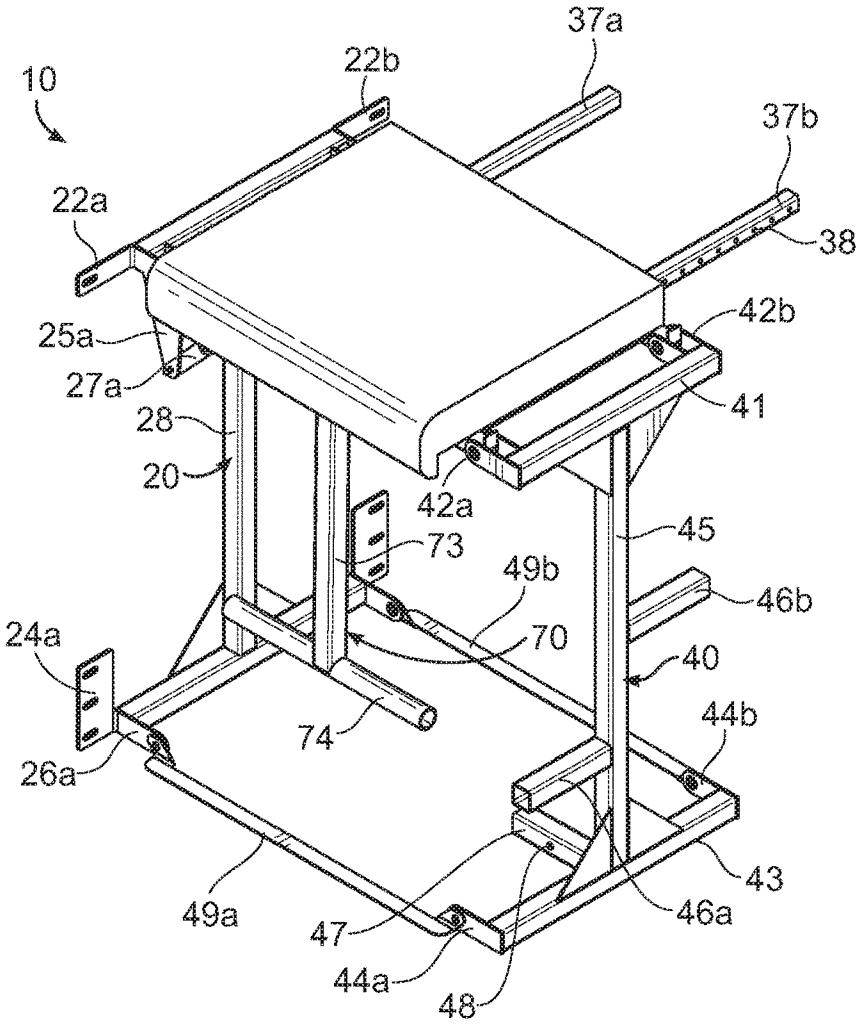
FIG. 1B is a perspective view of a wall-mounted collapsible exercise system in an expanded position with a pad on the body support in accordance with an example embodiment.

A. Overview.

An example wall-mounted collapsible exercise system generally comprises a mount support 20 adapted to be connected to a structure 16 such as a wall. A body support 30 may be pivotably connected to the mount support 20 such that the body support 30 pivots with respect to the mount support 20, wherein the body support 30 comprises an outer end and an inner end and wherein the inner end of the body support 30 is pivotably connected to the mount support 20. A base support 40 may be pivotably connected to the body support 30 such that the base support 40 pivots with respect to the body support 30.

The body support 30 and the base support 40 may be pivotable between a first position and a second position, wherein in the first position the base support 40 and the body support 30 are collapsed against the mount support 20 and wherein in the second position the body support 30 extends outwardly from the wall 16 at a perpendicular orientation with respect to the wall 16. A swing arm 70 may be pivotably connected to the body support 30; the swing arm 70 being adapted to receive a weight 75. An attachment mount 37*a*, 37*b* may be connected to the body support 30; the attachment mount 37*a*, 37*b* being adapted to receive one or more exercise attachments. One or more steps 46 may be connected to the base support 40. A linkage 49*a*, 49*b* may be pivotably connected at a first end to the mount support 20 and at a second end to the base support 40.

The mount support 20 may comprise an upper member 21 and a lower member 23; with the upper and lower members 21, 23 each being connected to the wall 16. The body support 30 may be pivotably connected to the upper member 21 of the mount support 20. The base support 40 may comprise an upper member 41, a lower member 43, and a central member 45. The upper member 41 of the base support 40 may be pivotably connected to the outer end of the body support 30. The base support 40 may comprise a connector member 47 extending inwardly from the central member 45 of the base support 40; with the connector member 47 being adapted to be connected to the mount support 20 when the base support 40 is in the first (collapsed) position. A locking member 18 such as a U-bolt may be adapted to removably connect the connector member 47 and the mount support 20 when the base support 40 is in the first position.

An actuator 27*a*, 27*b* may be connected between the mount support 20 and the body support 30; with the actuator 27*a*, 27*b* being adapted to adjust the body support 30 between the first and second positions. The actuator 27*a*, 27*b* may comprise a pneumatic actuator in some embodiments.

The one or more exercise attachments may comprise a roller assembly 55; with the roller assembly 55 being removably connected to the attachment mount 37*a*, 37*b* to form a glute ham developer configuration 50. The one or more exercise attachments may further comprise a handle assembly 62; with the handle assembly 62 being removably connected to the attachment mount 37*a*, 37*b* to form a reverse hyper configuration 60.

Another exemplary embodiment of a wall-mounted collapsible exercise system 10 may comprise a mount support 20 adapted to be connected to a wall 16, wherein the mount support 20 comprises an upper member 21 and a lower member 23; the upper member 21 and the lower member 23 each being connected to the wall 16. A body support 30 may be pivotably connected to the upper member 21 of the mount support 20, wherein the body support 30 comprises an outer end and an inner end, wherein the inner end of the body support 30 is pivotably connected to the mount support 20. A base support 40 may be pivotably connected to the outer end of the body support 30 such that the base support 40 pivots with respect to the body support 30, wherein the base support 40 comprises an upper end and a lower end. A linkage 49*a*, 49*b* may be pivotably connected at a first end to the lower member 23 of the mount support 20 and at a second end to the lower end of the base support 40.

The body support 30 and the base support 40 may be pivotable between a first position and a second position, wherein in the first position the body support 30 extends along the wall 16 at a parallel orientation with respect to the wall 16 and wherein in the second position the body support 30 extends outwardly from the wall 16 at a perpendicular orientation with respect to the wall 16. In the first position the base support 40 may be positioned against the body support 30 at a parallel orientation with respect to the wall 16. In the second position, the lower end of the base support 40 may be positioned on a ground surface 17 such as the floor. In the second position, the body support 30 may be adapted to be converted between a glute ham developer configuration 50 and a reverse hyper configuration 60. A swing arm 70 may be pivotably connected to the body support 30; the swing arm 70 being adapted to receive a weight 75. An attachment mount 37*a*, 37*b* may be connected to the body support 30; the attachment mount 37*a*, 37*b* being adapted to receive one or more exercise attachments to convert the body support 30 between the GHD configuration 50 and the reverse hyper configuration 60.

A support pad 51 may be adapted to be removably connected to the body support 30. A support pad bracket 52 may removably connect the support pad 51 to the body support 30; the support pad bracket 52 comprising a base 54 which rests on the body support 30 and a flange connector 53 which extends around a side or end of the body support 30 to secure the support pad 51 removably to the body support 30.

B. Mount Support.

As shown throughout the figures, the wall-mounted collapsible exercise system 10 may include a mount support 20 adapted to be connected to a surface 16 such as a wall. It should be appreciated that, while the figures illustrate an exemplary embodiment in which the surface 16 is vertically-oriented, the mount support 20 may in alternate embodiments be connected to horizontal surfaces (such as a floor) or diagonal surfaces (such as a slanted wall).

It should be appreciated that the shape, size, structure, and configuration of the mount support 20 may vary in different embodiments. In the exemplary embodiment best shown in FIGS. 1A and 1B, the mount support 20 may comprise an upper member 21, a lower member 23, and a central member 28 connected between the upper and lower members 21, 23. Thus, in the exemplary embodiment shown in the figures, the mount support 20 may have an "I" shape.

It should be appreciated that the upper member 21, lower member 23, and central member 28 may comprise a variety of configurations. Although rectangular beams are shown, various other shapes may be utilized. Any type of elongated member capable of supporting the weight of the body support 30 and base support 40 may be utilized, including beams, rods, bars, poles, posts, and the like.

Figure 1A:
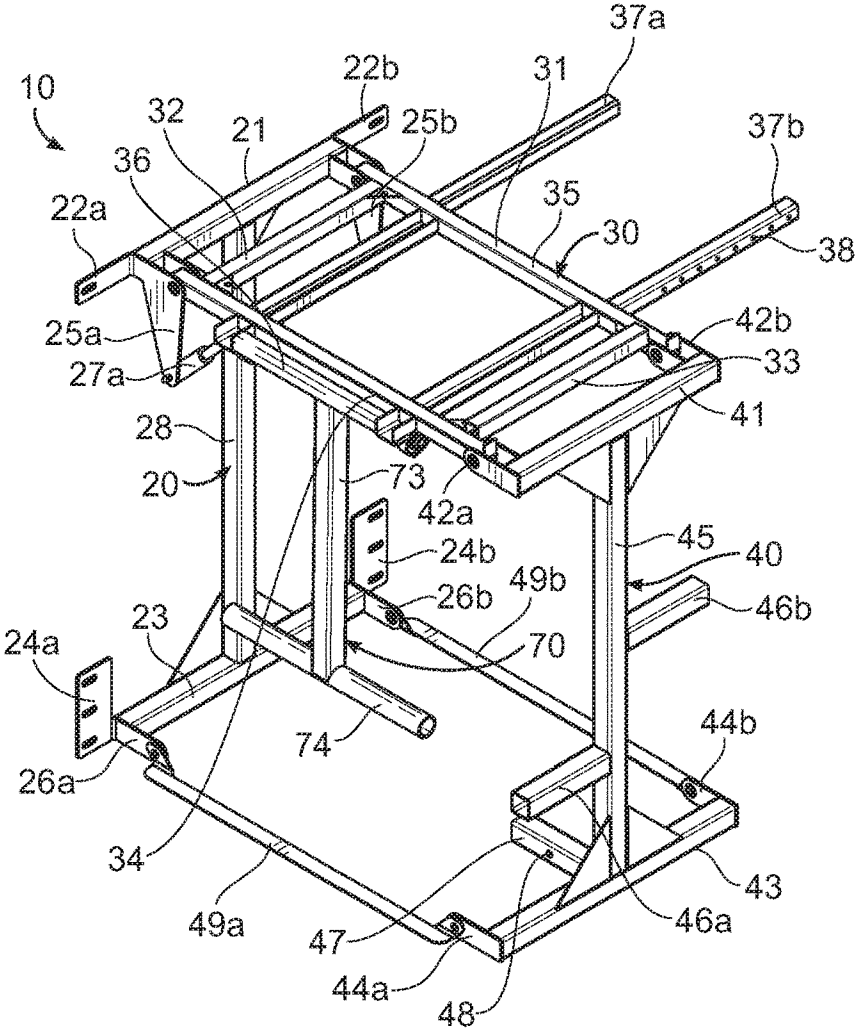
FIG. 1A is a perspective view of a wall-mounted collapsible exercise system in an expanded position in accordance with an example embodiment.

As best shown in FIGS. 1A and 1B, the upper member 21 of the mount support 20 may comprise upper brackets 22*a*, 22*b* which are connected to the surface 16, such as by fasteners 14. In the exemplary embodiment of the figures, the first upper bracket 22*a* is positioned at or near the first end of the upper member 21 and the second upper bracket 22*b* is positioned at or near the second end of the upper member 22.

Continuing to reference FIG. 1A, the lower member 23 of the mount support 20 may comprise lower brackets 24*a*, 24*b* which are connected to the surface 16, such as by fasteners 14. In the exemplary embodiment of the figures, the first lower bracket 24*a* is positioned at or near the first end of the lower member 23 and the second lower bracket 24*b* is positioned at or near the second end of the lower member 23.

Figure 7:
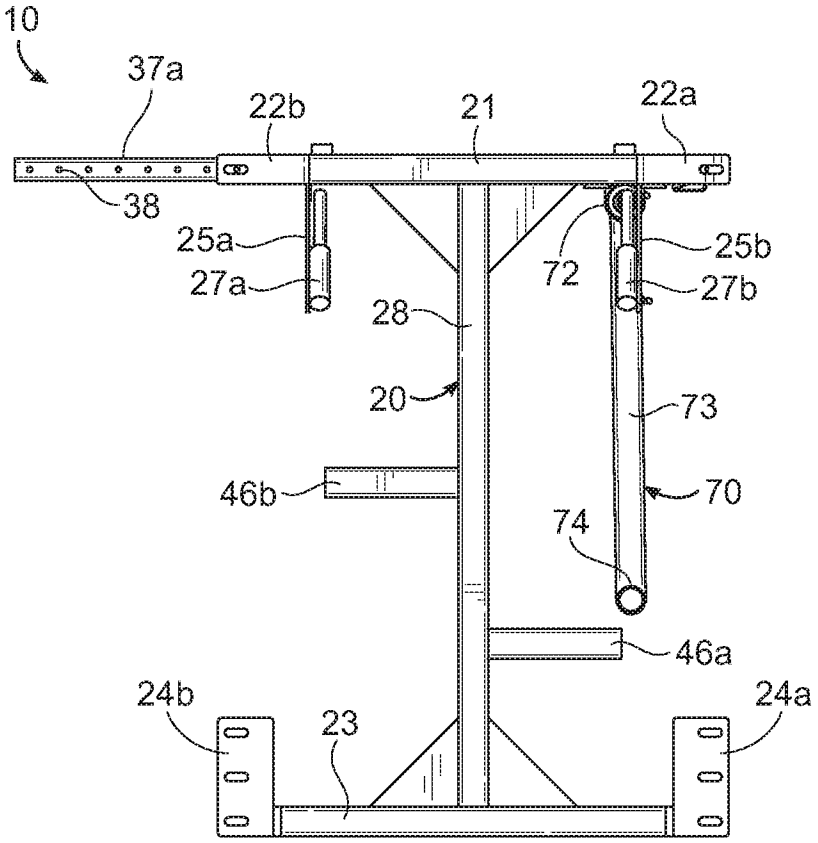
FIG. 7 is a second end view of a wall-mounted collapsible exercise system in an expanded position in accordance with an example embodiment.

It should be appreciated that various other bracket 22*a*, 22*b*, 24*a*, 24*b* configurations may be utilized in different embodiments. Each of the brackets 22*a*, 22*b*, 24*a*, 24*b* may comprise a plate having one or more openings through which fasteners 14 may extend to secure the brackets 22*a*, 22*b*, 24*a*, 24*b* and, by extension, the mount support 20 to the surface 16 as best shown in FIG. 7. Various other configurations known to secure a structure to a surface 16 such as a wall may be utilized, and the methods and systems described herein should thus not be construed as limited to the exemplary embodiment of brackets 22*a*, 22*b*, 24*a*, 24*b* shown in the figures.

It should be appreciated that more or less brackets 22*a*, 22*b*, 24*a*, 24*b* may be utilized in different embodiments. For example, the upper and lower members 21, 23 may in some embodiments only comprise a single bracket 22*a*, 24*a* each. In other embodiments, additional brackets 22*a*, 22*b*, 24*a*, 24*b* may be utilized, such as with larger configurations.

As best shown in FIGS. 1A and 1B, a body support 30 may be pivotably connected to the mount support 20 such that the body support 30 may pivot with respect to the mount support 20. The figures illustrate that the body support 30 pivots about a horizontal axis parallel with the ground surface 17. It should be appreciated that the body support 30 may pivot about other axes in different embodiments.

The body support 30 may be pivotably connected to the mount support 20 by one or more upper pivot connectors 25*a*, 25*b* such as shown in FIGS. 1A, 1B, 2, 3, and 4. In the exemplary embodiment shown in the figures, the body support 30 is illustrated as being pivotably connected to the upper member 21 of the mount support 20. In other embodiments, the body support 30 may be pivotably connected to other locations on the mount support 20, or directly to the surface 16.

In the exemplary embodiment shown in FIG. 1A, the body support 30 is pivotably connected to the upper member 21 of the mount support 20 by a pair of upper pivot connectors 25*a*, 25*b*. More or less upper pivot connectors 25*a*, 25*b* may be utilized in different embodiments.

In the exemplary embodiment shown in the figures, the upper pivot connectors 25*a*, 25*b* are each illustrated as comprising a bracket having a pivot pin about which the body support 30 may be pivotably connected. Other configurations may be utilized for the upper pivot connectors 25*a*, 25*b* in different embodiments so long as the body support 30 may pivot about the mount support 20 to alternate between a first (collapsed) position and a second (expanded) position.

Figure 10:
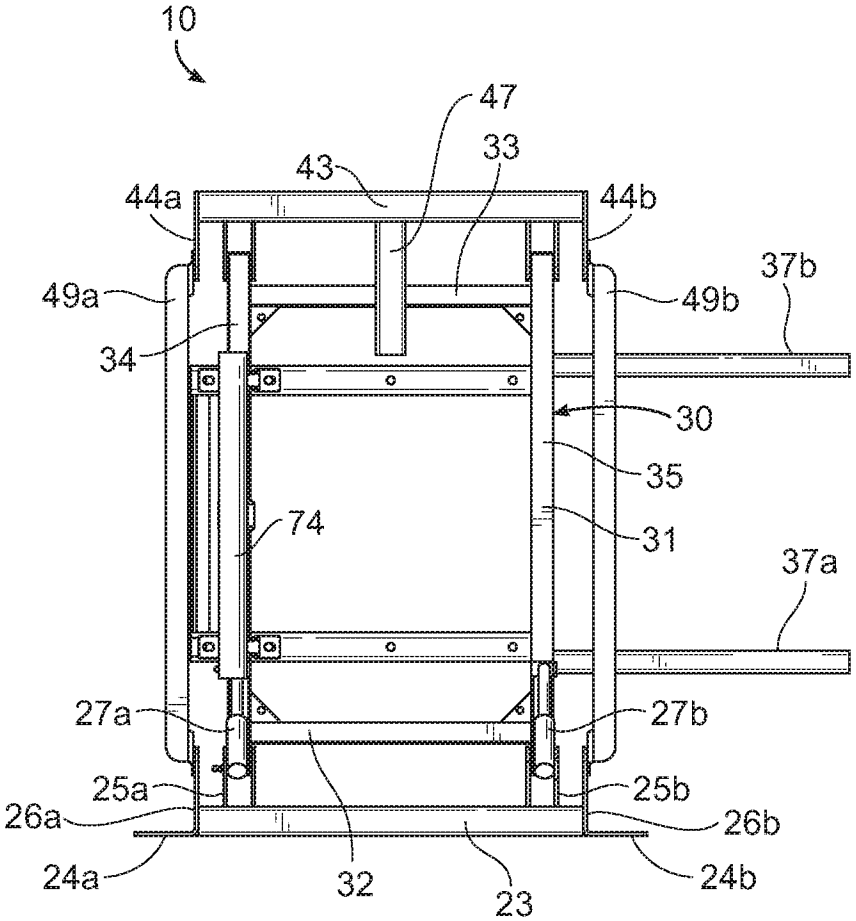
FIG. 10 is a top view of a wall-mounted collapsible exercise system in an expanded position in accordance with an example embodiment.
Figure 9:
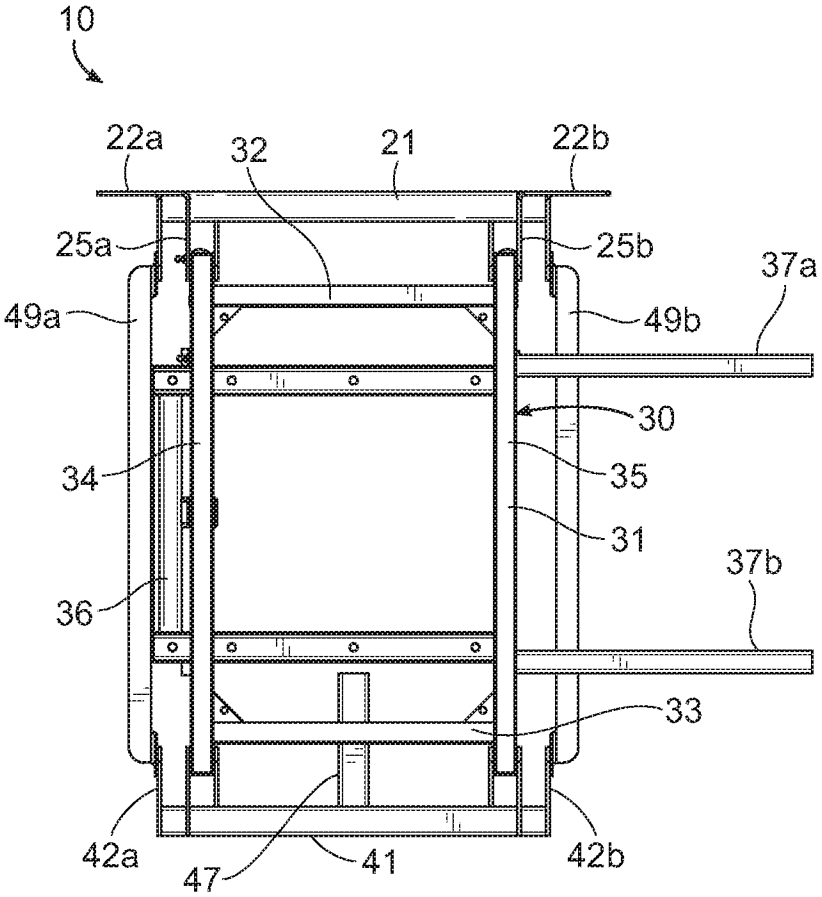
FIG. 9 is a bottom view of a wall-mounted collapsible exercise system in an expanded position in accordance with an example embodiment.
Figure 12:
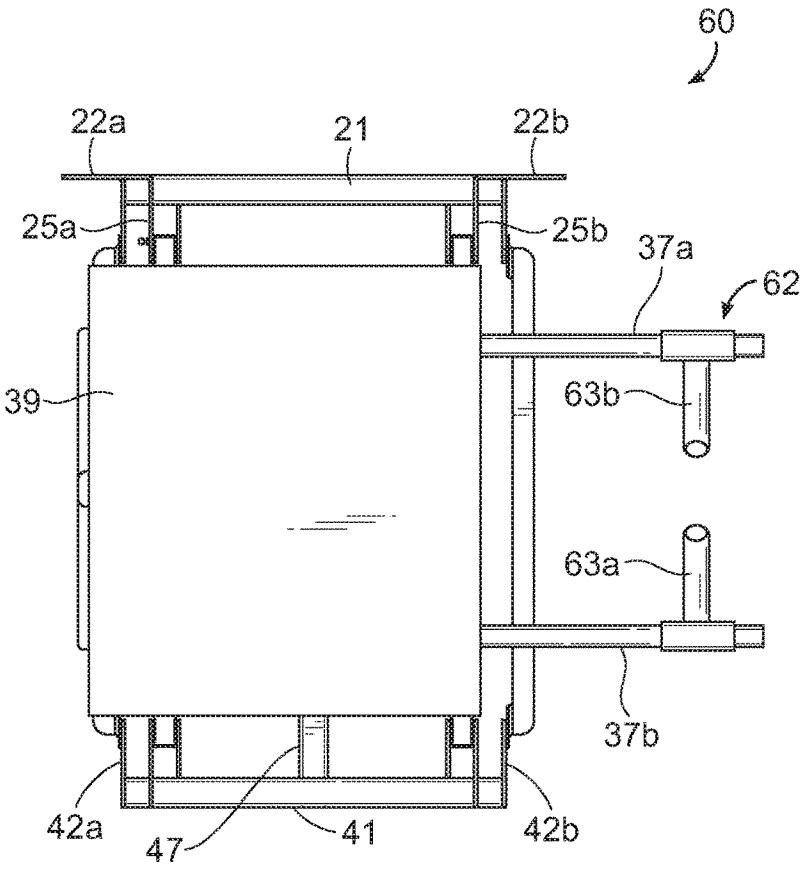
FIG. 12 is a top view of a wall-mounted collapsible exercise system in an expanded position configured to function as a reverse hyper extension machine in accordance with an example embodiment.

The base support 40 may similarly be pivotably linked or interconnected with the mount support 20 by one or more lower pivot connectors 26*a*, 26*b*, one or more linkages 49*a*, 49*b*, and one or more lower base connectors 44*a*, 44*b* such as shown in FIGS. 9 and 10. In the exemplary embodiment shown in the figures, the base support 40 is illustrated as being pivotably connected to the lower member 23 of the mount support 20 by a pair of linkages 49*a*, 49*b*. In other embodiments, the base support 40 may be pivotably connected to other locations on the mount support 20.

Figure 11:
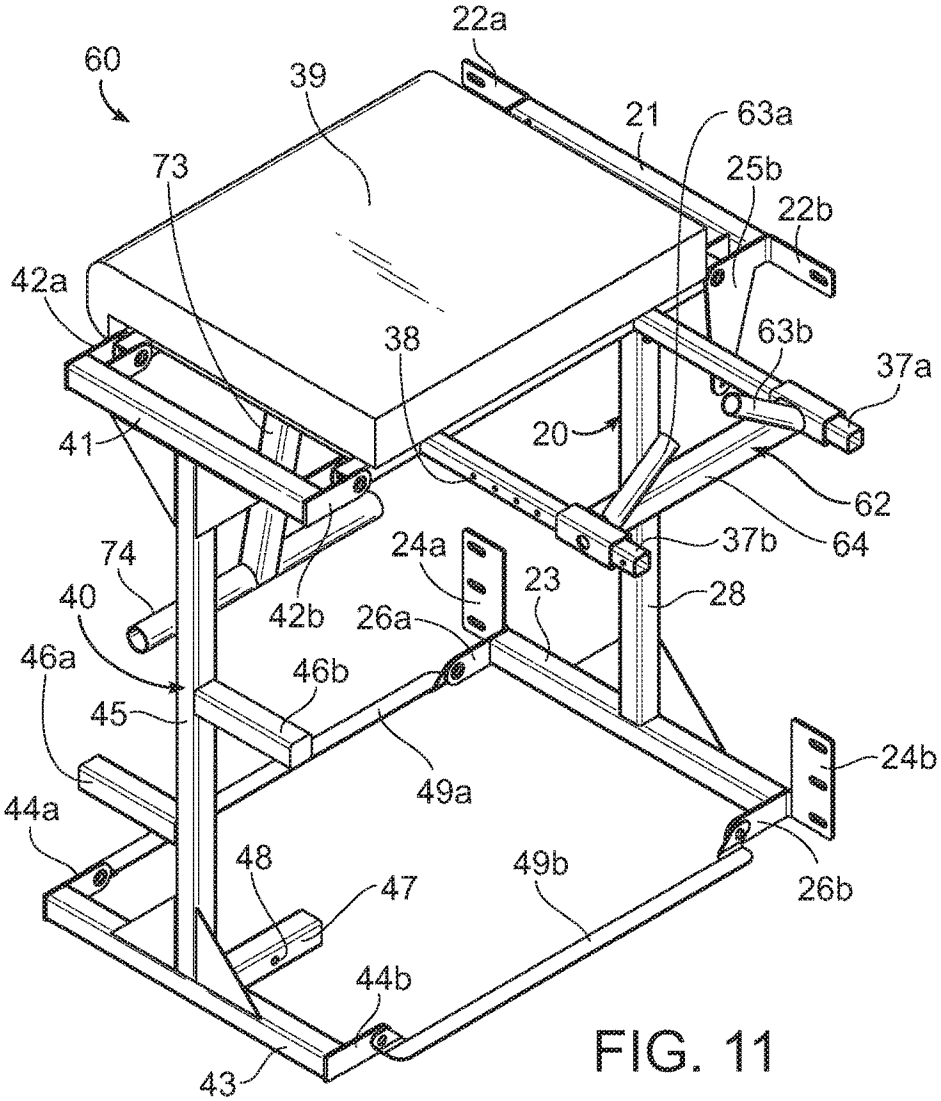
FIG. 11 is a perspective view of a wall-mounted collapsible exercise system in an expanded position configured to function as a reverse hyper extension machine in accordance with an example embodiment.
Figure 14:
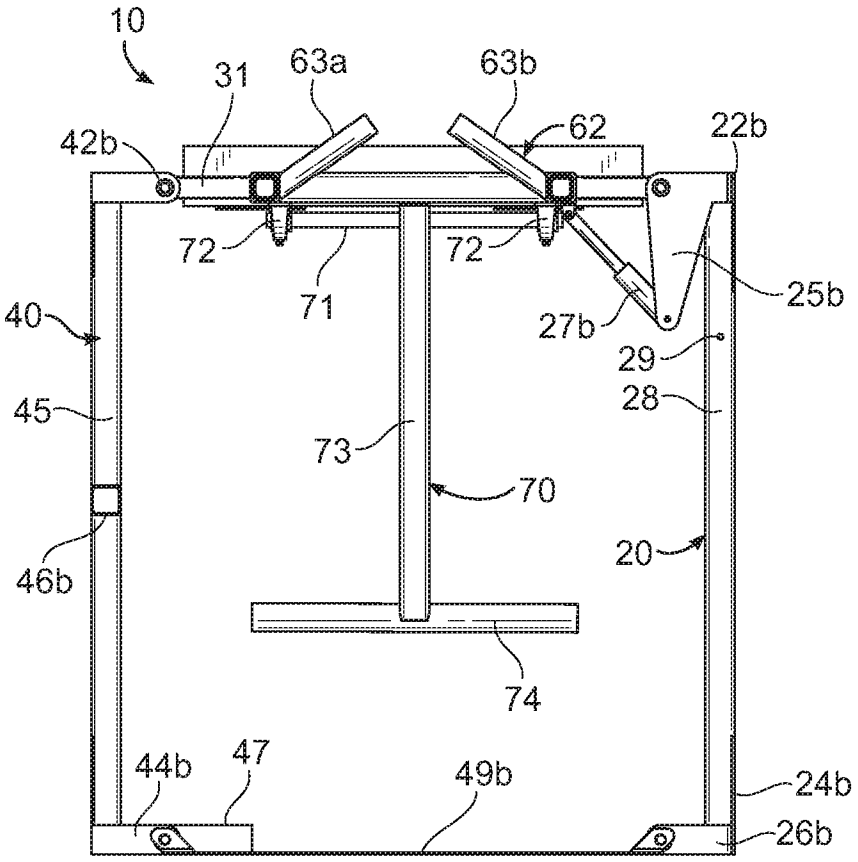
FIG. 14 is a side view of a wall-mounted collapsible exercise system in an expanded position configured to function as a reverse hyper extension machine in accordance with an example embodiment.

In the exemplary embodiment shown in the figures, the lower member 23 is illustrated as including a first lower pivot connector 26*a* positioned at or near its first end and a second lower pivot connector 26*b* positioned at or near its second end. As best shown in FIG. 11, a pair of linkages 49*a*, 49*b* may interconnect the mount support 20 and the base support 30. As shown in the figures, a first linkage 49*a* is pivotably connected at its first end to the first lower pivot connector 26*a* and a second linkage 49*b* is pivotably connected at its first end to the second lower pivot connector 26*b*.

The distal ends of the respective linkages 49*a*, 49*b* are pivotably connected to the base support 40 such that the base support 40 may pivot with respect to the mount support 20. The figures illustrate that the base support 40 may pivot about a horizontal axis parallel with the ground surface 17, but it should be appreciated that the base support 40 may pivot about alternate axes in some embodiments.

Each of the lower pivot connectors 26*a*, 26*b* may comprise a bracket having a pivot pin about which a corresponding linkage 49*a*, 49*b* may be connected. It should be appreciated that more or less lower pivot connectors 26*a*, 26*b* may be utilized in different embodiments. Further, the positioning of the lower pivot connectors 26*a*, 26*b* on the mount support 20 may vary in different embodiments.

As shown throughout the figures, actuators 27*a*, 27*b* may be utilized to aid in raising and lowering the body and base supports 30, 40 to transition between the first (collapsed) position and the second (expanded) position. In the exemplary embodiment shown in the figures, a pair of actuators 27*a*, 27*b* is shown. It should be appreciated that more or less actuators 27*a*, 27*b* may be utilized on some embodiments. Further, the positioning of the actuators 27*a*, 27*b* may vary in different embodiments.

Figure 16:
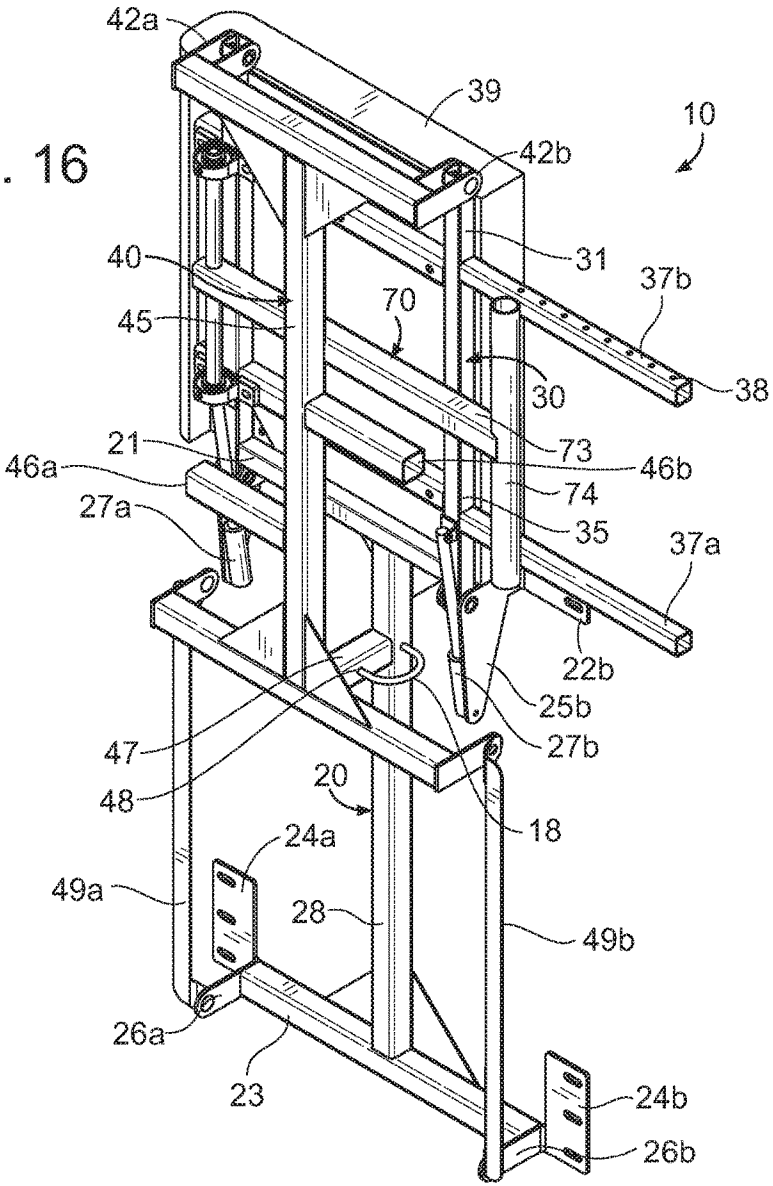
FIG. 16 is a perspective view of a wall-mounted collapsible exercise system in a collapsed position in accordance with an example embodiment.
Figure 19:
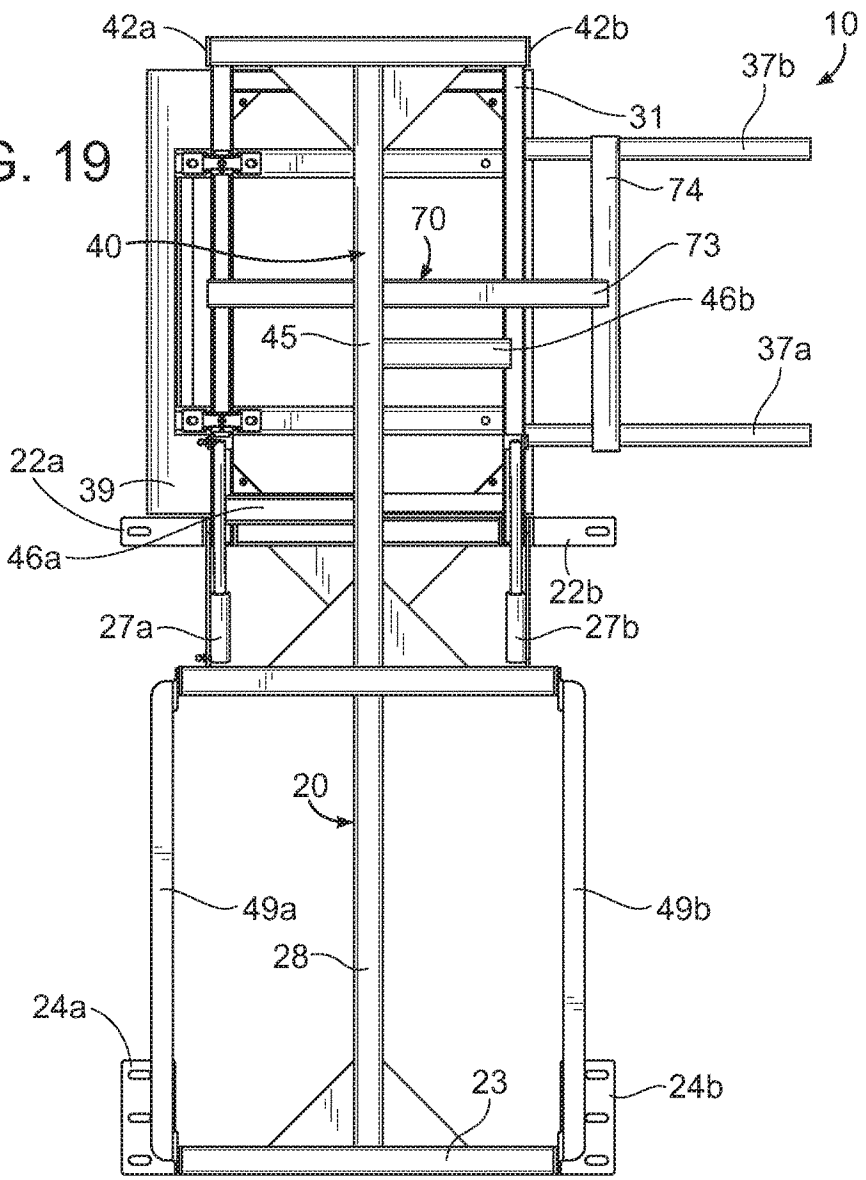
FIG. 19 is an end view of a wall-mounted collapsible exercise system in a collapsed position in accordance with an example embodiment.
Figure 18:
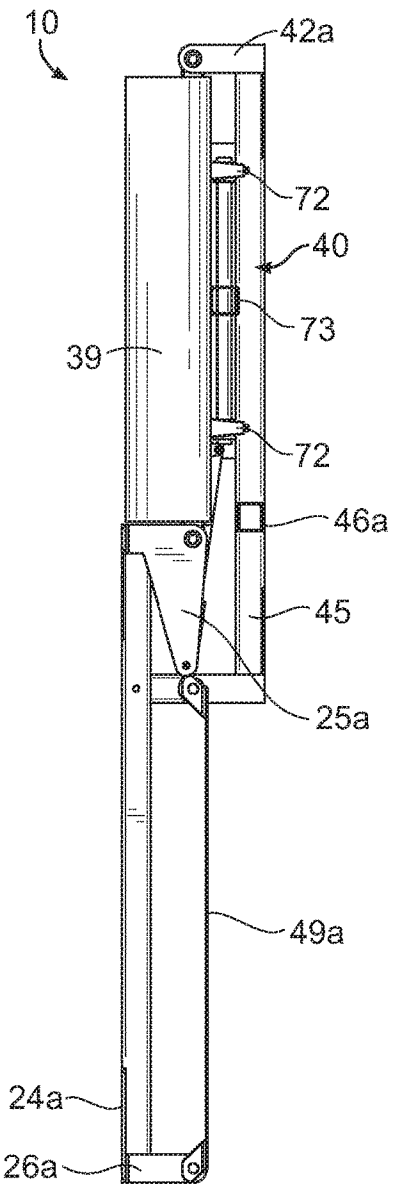
FIG. 18 is a second side view of a wall-mounted collapsible exercise system in a collapsed position in accordance with an example embodiment.

As best shown in FIG. 16, the actuators 27*a*, 27*b* in an exemplary embodiment may be connected between the mount support 20 and the body support 30. More specifically, a first actuator 27*a* may be connected between the first upper pivot connector 25*a* and the body support 30 and a second actuator 27*b* may be connected between the second upper pivot connector 25*b* and the body support 30.

When the actuators 27*a*, 27*b* are extended, the body support 30 (and interconnected base support 40) will pivot upwardly about a horizontal axis into the first (collapsed) position. When the actuators 27*a*, 27*b* are retracted, the body support 30 (and interconnected base support 40) will pivot downwardly about the horizontal axis into the second (expanded) position. When in the first position, the body support 30 and the base support 40 may be collapsed against the mount support 20 such as shown in FIG. 16.

The type of actuators 27*a*, 27*b* utilized may vary in different embodiments. By way of example, the actuators 27*a*, 27*b* could comprise pneumatic actuators such as shock actuators. In other embodiments, the actuators 27*a*, 27*b* could comprise non-linear actuators, electric actuators, hydraulic actuators, and the like.

The actuators 27*a*, 27*b* may function passively, by providing assistance when the body support 30 is manually lifted or lowered. In other embodiments, the actuators 27*a*, 27*b* may function actively without requirement of any force input from a user. The actuators 27*a*, 27*b* may be remotely controlled in some embodiments.

The actuators 27*a*, 27*b* may also aid in maintaining the body support 30 in the raised collapsed position either by themselves or in connection with a locking member 29 discussed herein. As shown in FIG. 16, the central member 28 may include an opening 29 adapted to receive a locking member 18 that secures the base support 40 to the mount support 20 when in the first (collapsed) position which is discussed in more detail below.

C. Body Support.

Figure 20:
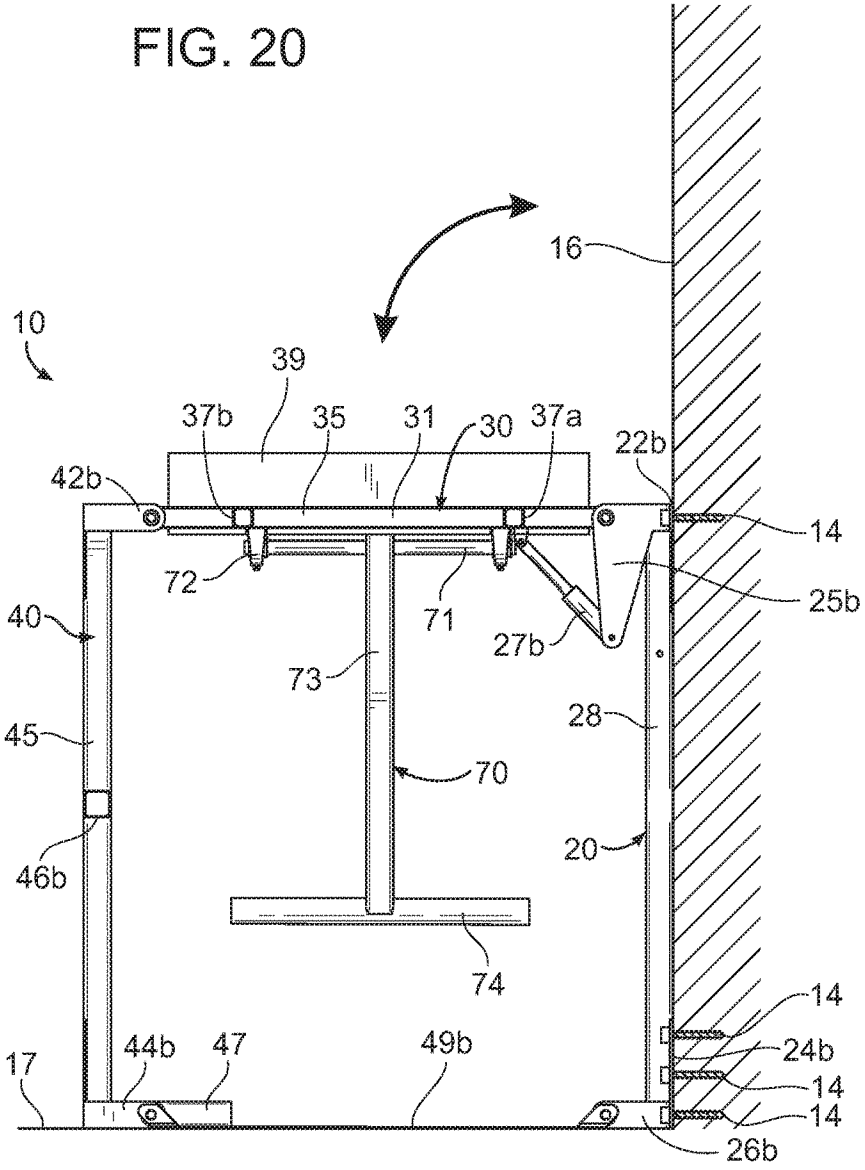
FIG. 20 is a side view of a wall-mounted collapsible exercise system in an expanded position in accordance with an example embodiment.
Figure 22:
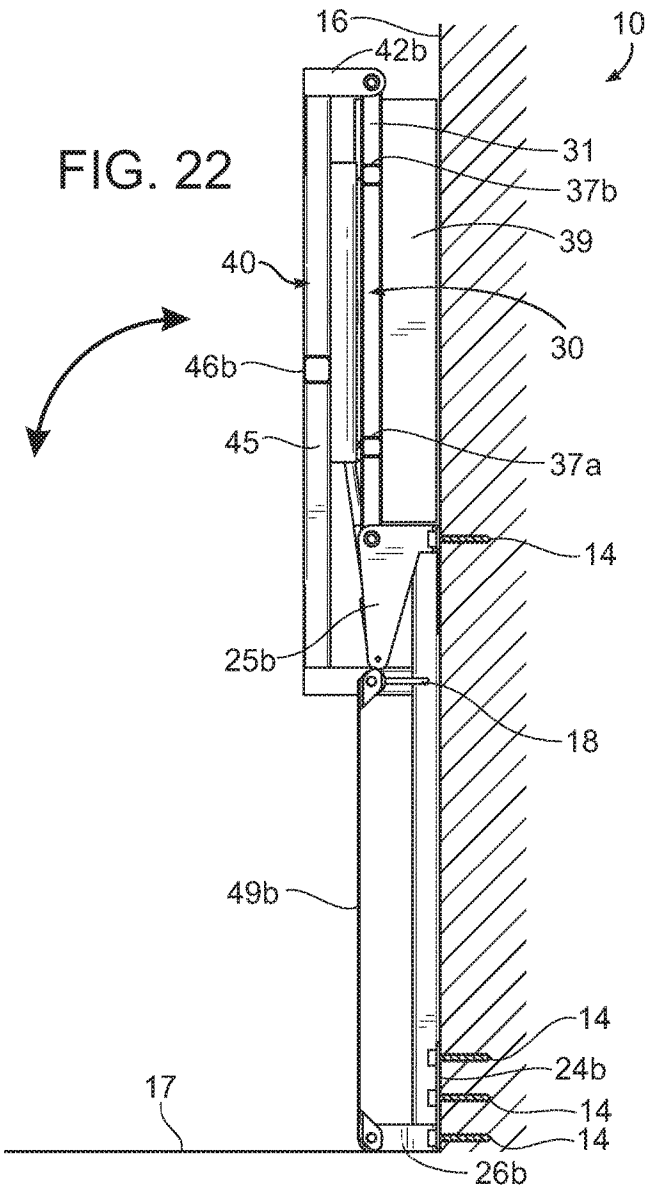
FIG. 22 is a side view of a wall-mounted collapsible exercise system in a collapsed position in accordance with an example embodiment.
Figure 23:
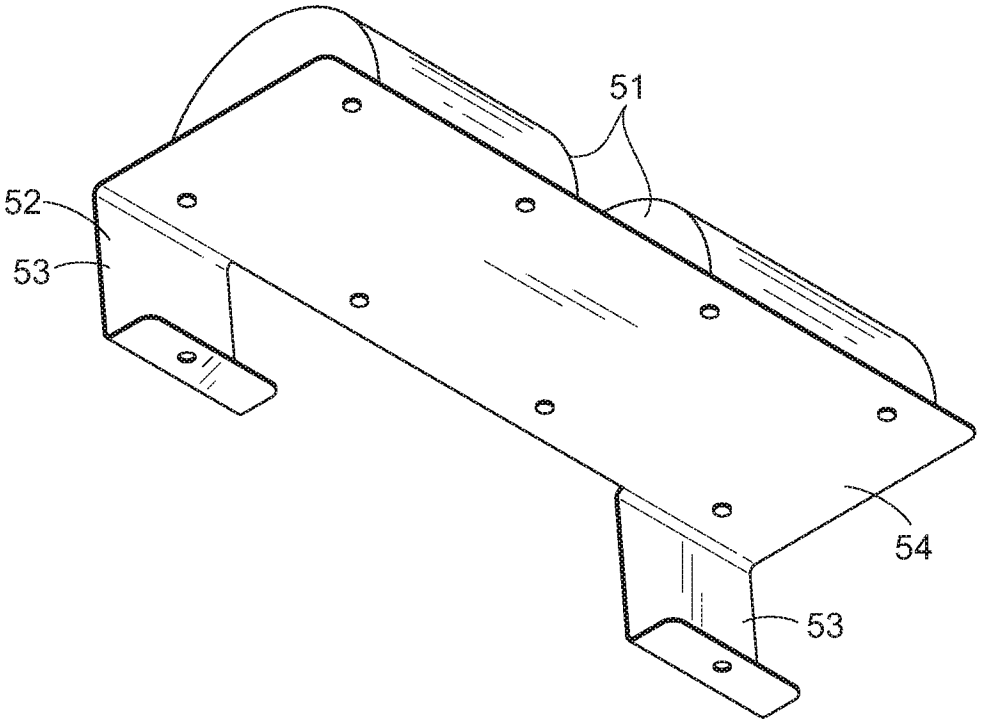
FIG. 23 is a bottom perspective view of support pads and a support bracket of a wall-mounted collapsible exercise system in accordance with an example embodiment.

As shown throughout the figures, the wall-mounted collapsible exercise system 10 may comprise a body support 30 on which various exercises may be performed. The body support 30 may be pivoted between a first (collapsed) position in which the body support 30 extends along the surface 16 at a parallel orientation with respect to the surface 16 such as shown in FIG. 22 and a second (expanded) position in which the body support 30 extends outwardly from the surface 16 at a perpendicular orientation with respect to the surface 16 such as shown in FIG. 20. FIG. 23 illustrates the body support 30 being adjusted between the first and second positions. When in the first position, the body support 30 is collapsed against the surface 16 above the mount support 20 such as shown in FIG. 22.

Through the use of exercise attachments such as support pads 51, a roller assembly 55, and a handle assembly 62, the body support 30 may be converted between a GHD configuration 50 and a reverse hyper configuration 60 when in its second (expanded) position.

As best shown in FIGS. 1A and 16, the body support 30 may comprise a frame 31. In the exemplary embodiment shown in the figures, the frame 31 may comprise a first end member 32, a second end member 33, a first side member 34, and a second side member 35; with the first and second end members 32, 33 being parallel with each other and the first and second side members 34, 35 being parallel with each other to form a rectangular shape. It should be appreciated that various other configurations and shapes may be utilized. For example, the frame 31 may comprise a simple plate member in some embodiments.

The body support 30 is adapted to support the body of the exerciser 12 when the body support 30 is lowered into the second position for use. The manner in which the exerciser 12 rests on the body support 30 may vary depending on the type of exercise being performed. As shown in FIG. 1B, a pad 39 may be connected to or position on top of the body support 30 to provide cushioning and comfort when the exerciser 12 is on the body support 30. The pad 39 may be integrally formed or removably connected to the body support 30 in different embodiments.

Figure 13:
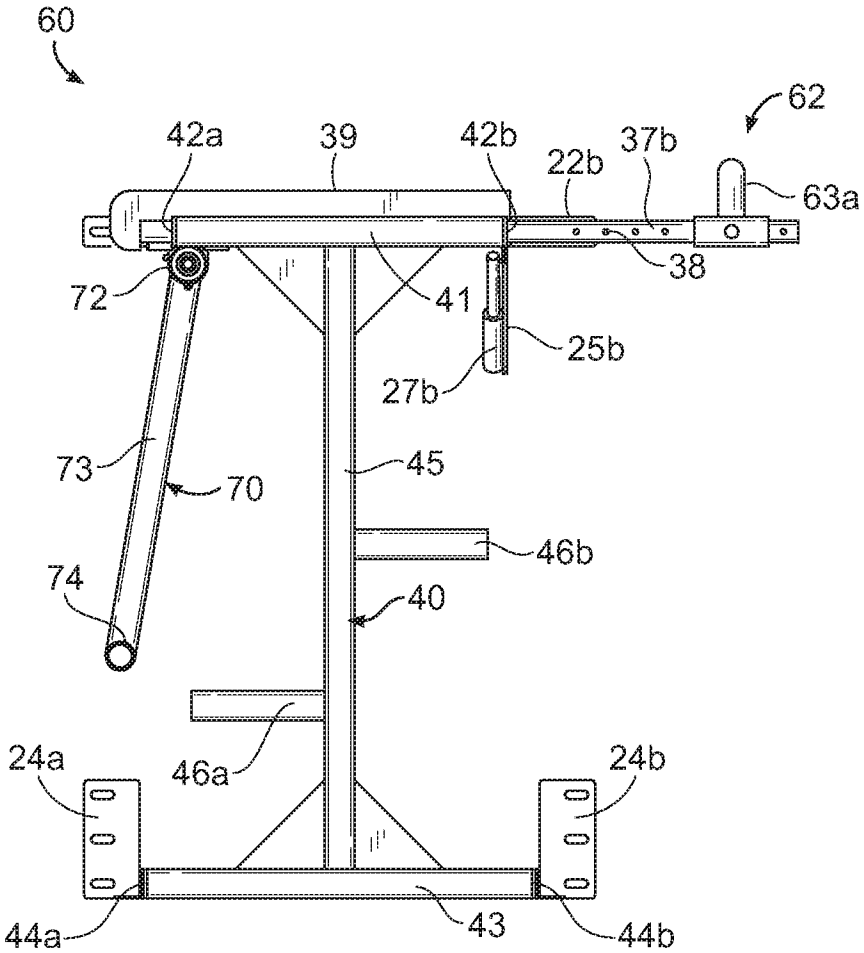
FIG. 13 is an end view of a wall-mounted collapsible exercise system in an expanded position configured to function as a reverse hyper extension machine in accordance with an example embodiment.

As shown in FIG. 1A, embodiments which utilize a frame 31 may include pad supports 36. In the exemplary embodiment shown in the figures, the pad supports 36 are illustrated as extending between the first and second side members 34, 35 of the body support 30. The pad 39 may thus be positioned over the pad supports 36 to rest on the frame 31. The pad 39 may in some embodiments include a flange which rests against the first side member 34 of the body support 30 such as shown in FIG. 13. The pad 39 may rest on the body support 30 or may be secured thereto, such as by adhesives or fasteners.

Figure 24:
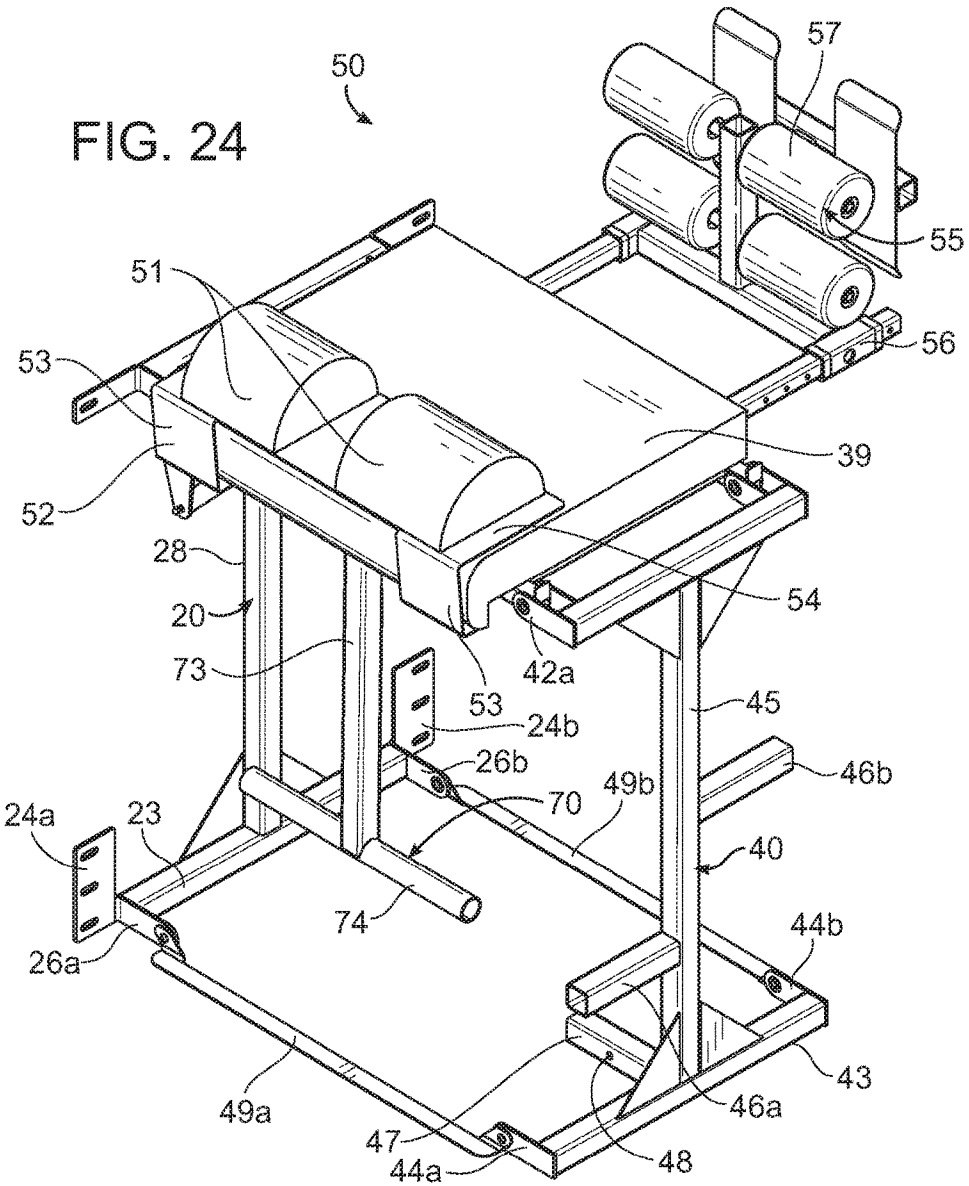
FIG. 24 is a perspective view of a wall-mounted collapsible exercise system in an expanded position configured to function as a glute ham developer in accordance with an example embodiment.
Figure 26:
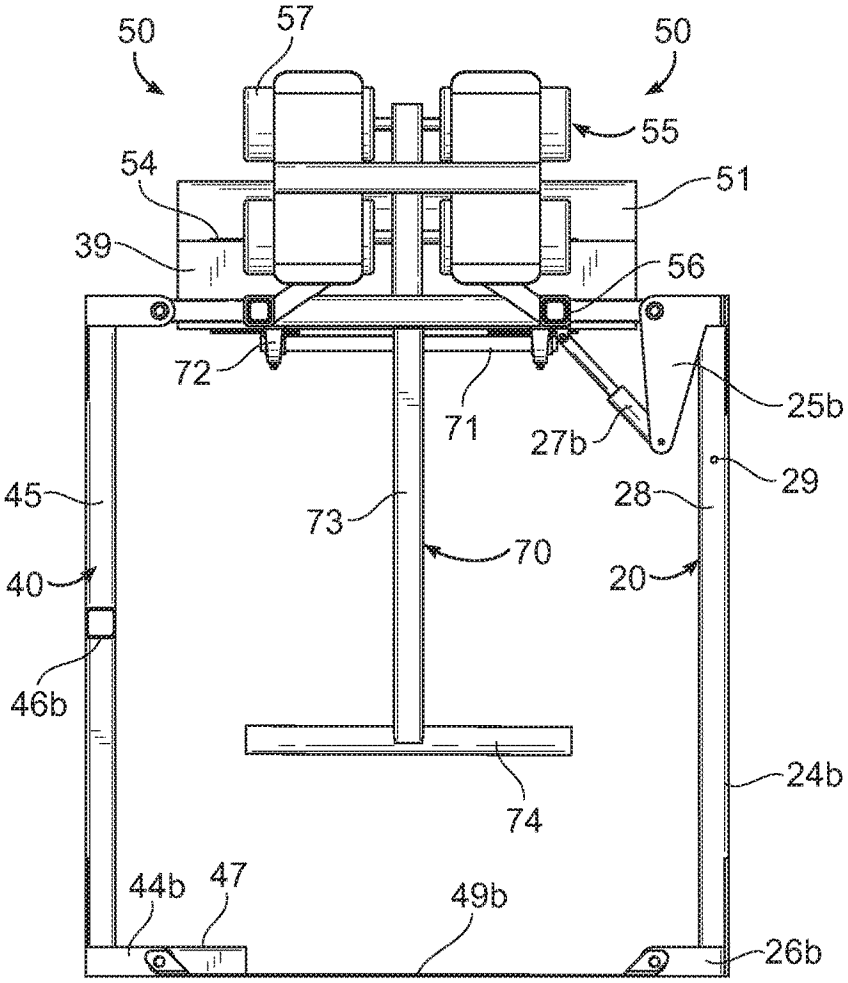
FIG. 26 is a first side view of a wall-mounted collapsible exercise system in an expanded position configured to function as a glute ham developer in accordance with an example embodiment.
Figure 25:
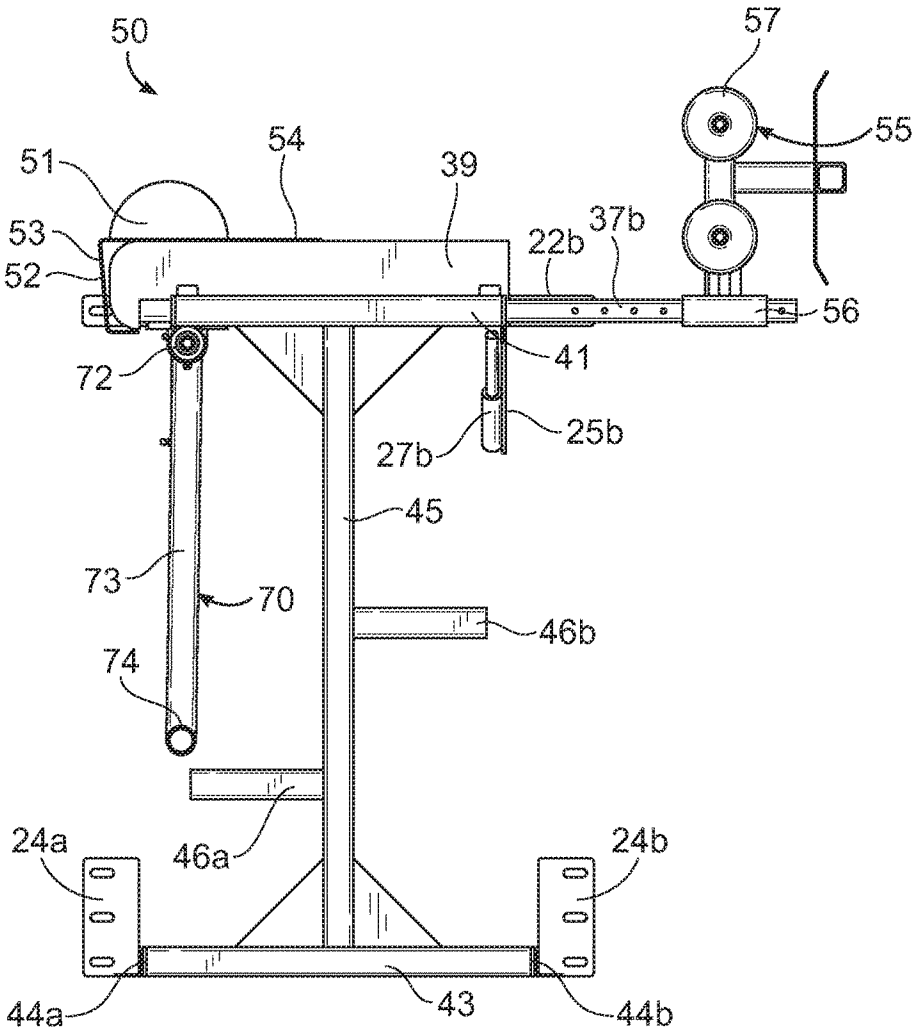
FIG. 25 is a first end view of a wall-mounted collapsible exercise system in an expanded position configured to function as a glute ham developer in accordance with an example embodiment.
Figure 28:
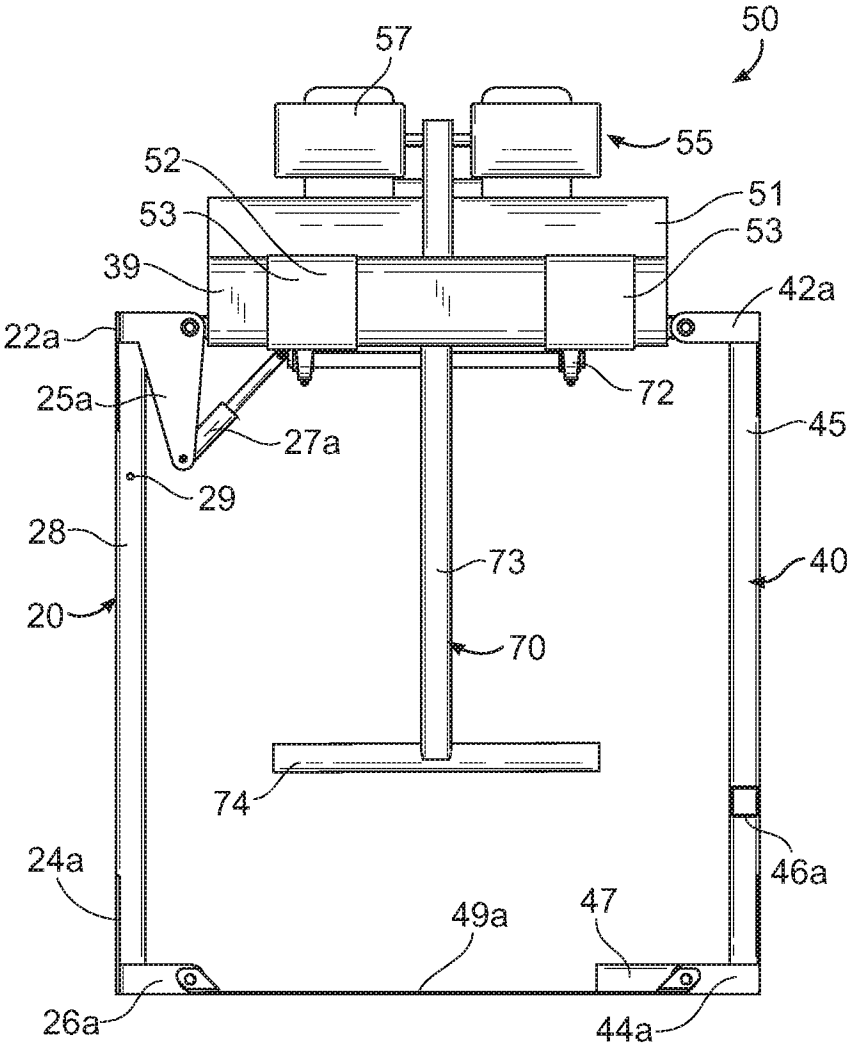
FIG. 28 is a second side view of a wall-mounted collapsible exercise system in an expanded position configured to function as a glute ham developer in accordance with an example embodiment.
Figure 27:
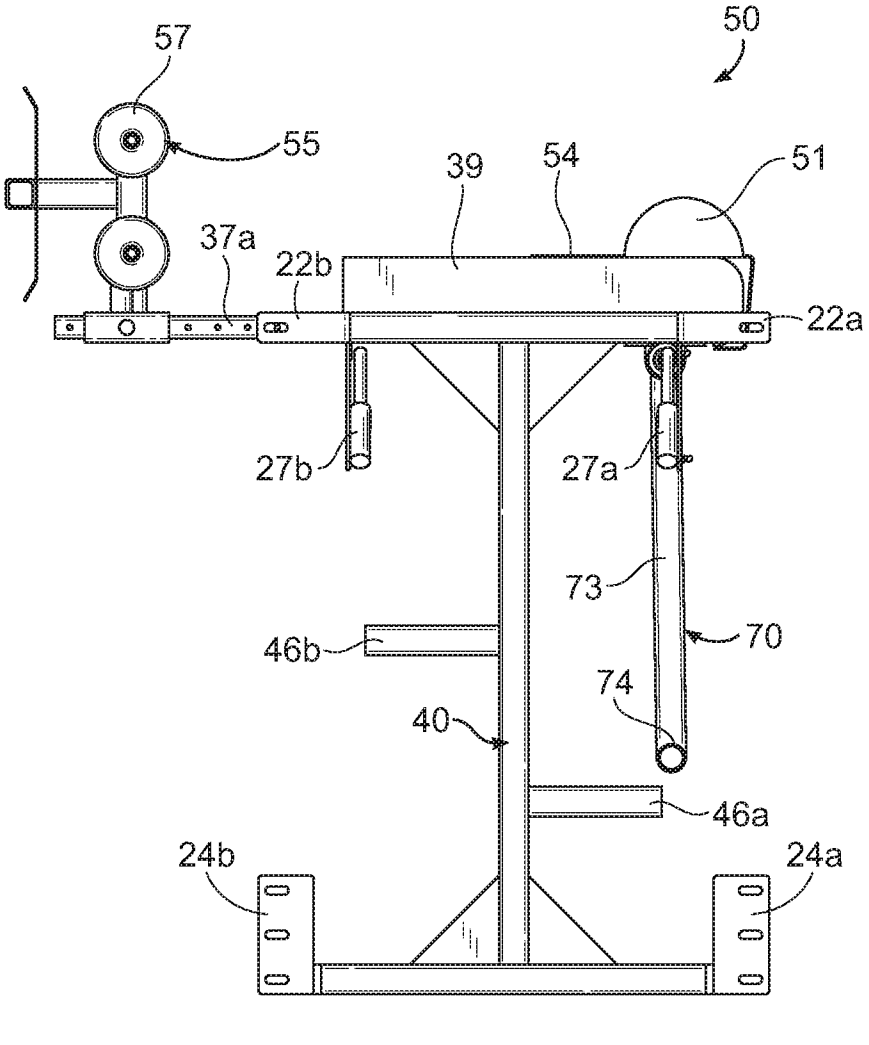
FIG. 27 is a second end view of a wall-mounted collapsible exercise system in an expanded position configured to function as a glute ham developer in accordance with an example embodiment.
Figure 30:
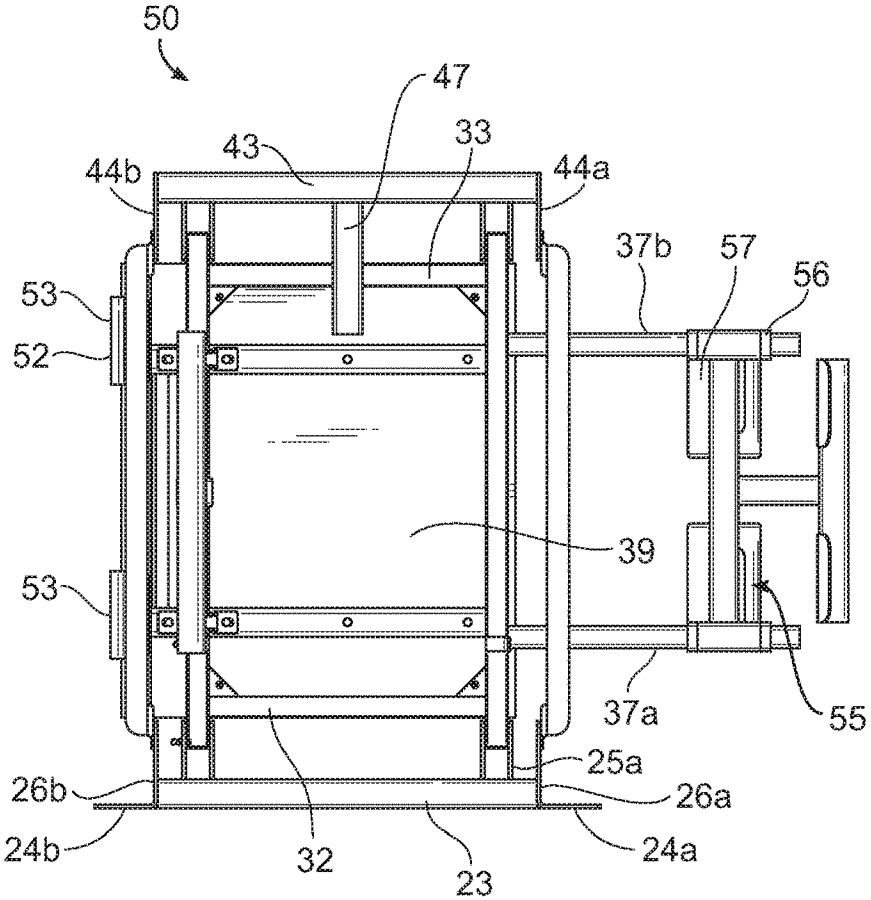
FIG. 30 is a bottom view of a wall-mounted collapsible exercise system in an expanded position configured to function as a glute ham developer in accordance with an example embodiment.
Figure 29:
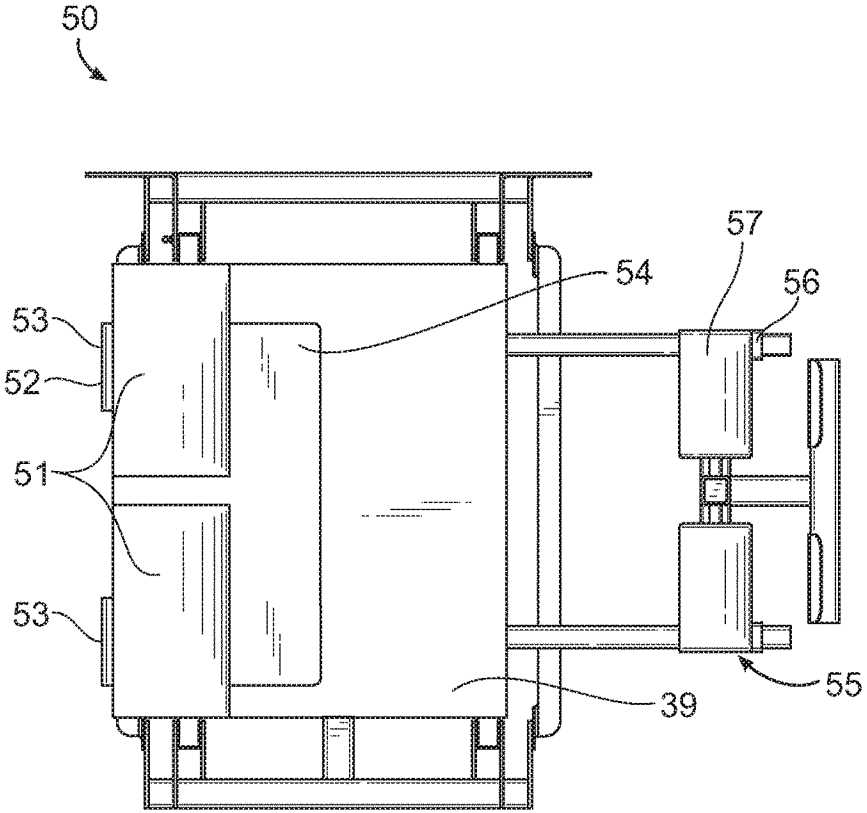
FIG. 29 is a top view of a wall-mounted collapsible exercise system in an expanded position configured to function as a glute ham developer in accordance with an example embodiment.

As best shown in FIGS. 1A, 1B, 5, 7, and 9-11, the body support 30 may include one or more attachment mounts 37*a*, 37*b* adapted to receive and secure various exercise attachments. By way of example, an exercise attachment comprised of a handle assembly 62 may be utilized in the reverse hyper configuration 60 such as shown in FIG. 11. A further example is shown in FIG. 24, in which a roller assembly 55 is connected to the attachment mounts 37*a*, 37*b* in the GHD configuration 50.

The figures illustrate an exemplary embodiment comprising a first attachment mount 37*a* and a second attachment mount 37*b*. Each of the attachment mounts 37*a*, 37*b* is illustrated as comprising an elongated member such as a rod, beam, or the like which extends outwardly from the body support 30. Each attachment mount 37*a*, 37*b* is illustrated as comprising a plurality of attachment openings 38 which extend in a row along the length of the attachment mount 37*a*, 37*b* such as shown in FIG. 1A. These attachment openings 38 may receive fasteners to secure exercise attachments such as a roller assembly 55 or handle assembly 62 to the body support 30.

In the exemplary embodiment shown in the figures, the attachment mounts 37*a*, 37*b* are illustrated as extending outwardly from and perpendicular to the second side member 35 of the frame 31 of the body support 30. Various other locations may be utilized. For example, the attachment mounts 37*a*, 37*b* may in some embodiments extends from the first side member 32 or the second end member 33 of the body support 30.

The shape, size, and number of attachment mounts 37*a*, 37*b* may vary in different embodiments. Thus, the exemplary embodiment showing a pair of attachment mounts 37*a*, 37*b* should not be construed as limiting in scope. For example, more or less attachment mounts 37*a*, 37*b* may be utilized in different embodiments. A single attachment mount 37*a* could be utilized in some embodiments.

Figure 15:
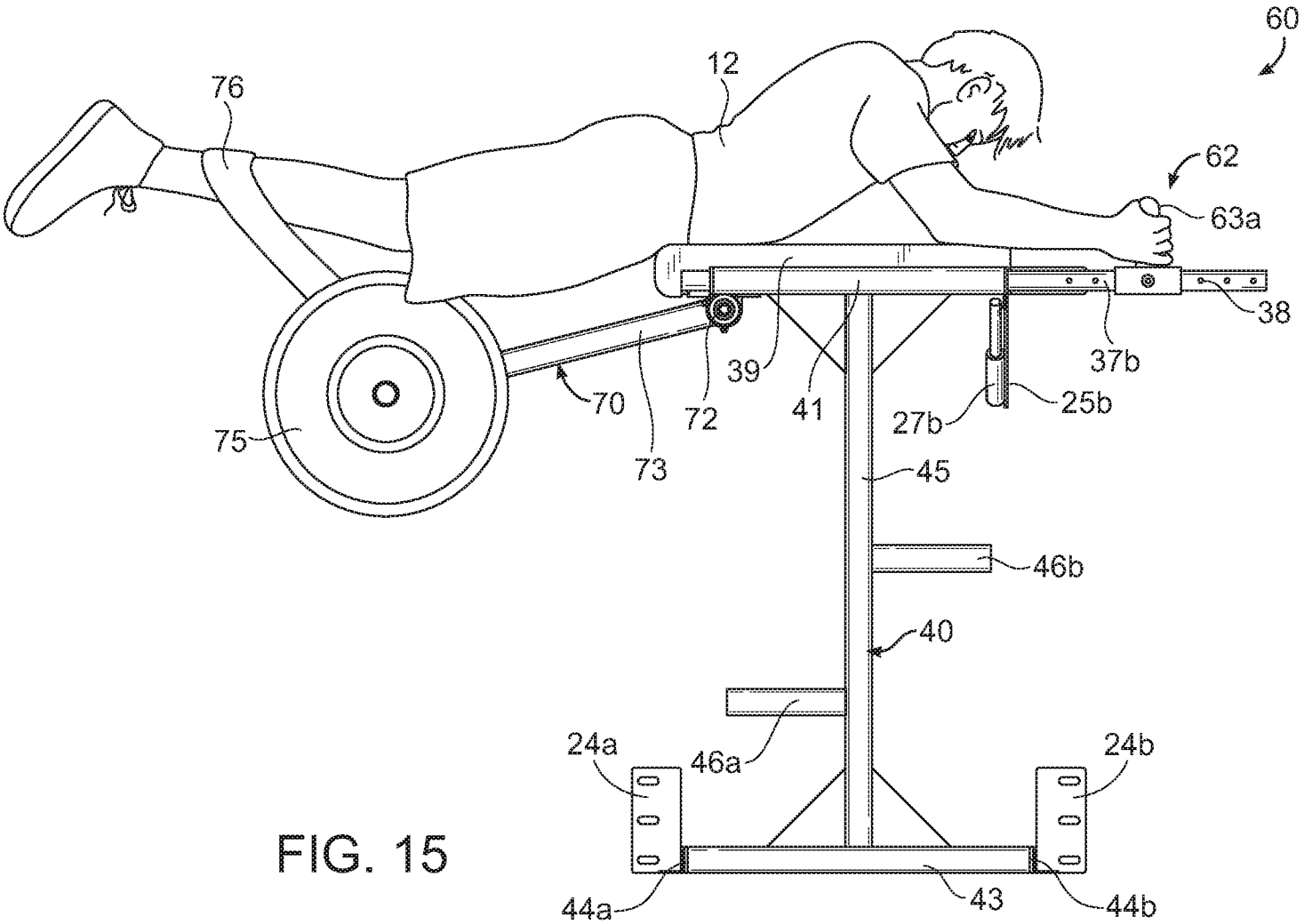
FIG. 15 is an end view of a wall-mounted collapsible exercise system in an expanded position configured to function as a reverse hyper extension machine in use in accordance with an example embodiment.
Figure 17:
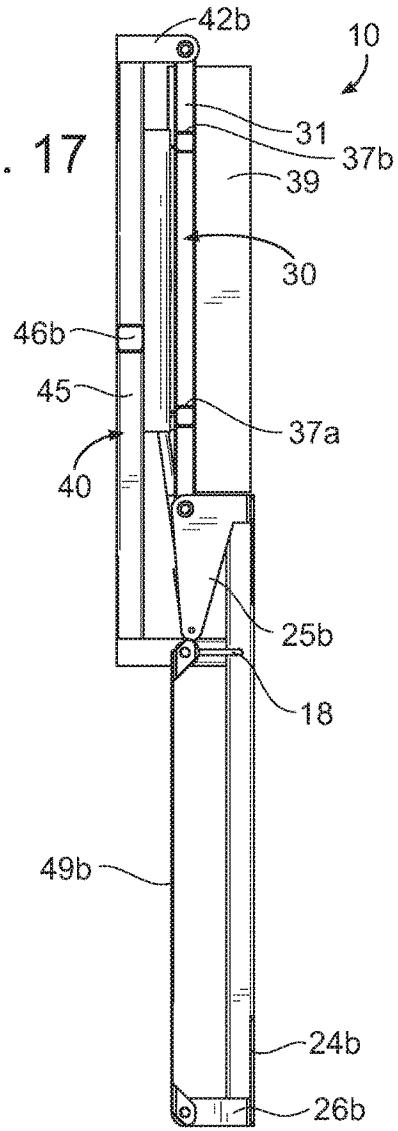
FIG. 17 is a first side view of a wall-mounted collapsible exercise system in a collapsed position in accordance with an example embodiment.

As best shown in FIGS. 3, 6-8, 13, and 14 and a swing arm 70 may be pivotably connected to the body support 30. The swing arm 70 may be utilized during various exercises, particularly when the body support 30 is in the reverse hyper configuration 60 such as shown in FIG. 15. The swing arm 70 may include an upper member 71 which is connected to the underside of the body support 30 by a pair of pivot connectors 72. The upper member 71 may thus pivot with respect to the body support 30 such that the swing arm 70 may swing with respect to the body support 30, similar to a pendulum.

The swing arm 70 may comprise a central member 73 extending downwardly from the upper member 71. The central member 73 may pivot with the upper member 71 to allow the swing arm 70 to freely swing. A pair of weight supports 73 extends perpendicularly in either direction from the central member 73 such as shown in FIG. 1B. The weight supports 73 may be adapted to removably receive one or more weights 75 to increase the resistance applied by the swing arm 70 when moved by an exerciser 12. A strap 76 as shown in FIG. 15 may be connected to the swing arm 70; with an exercise 12 placing his or her legs into the strap 76 to raise or lower the swing arm 70 against the resistance offered by the weights 75 such as shown in FIG. 15.

D. Base Support.

As shown throughout the figures, the wall-mounted collapsible exercise system 10 may comprise a base support 40 which supports the body support 30 in a horizontal configuration when the base support 40 is in the second (expanded) position for use. The base support 40 may be pivotable between a first (collapsed) position in which the base support 40 is positioned against the body support 30 at a parallel orientation with respect to the surface 16 such as shown in FIG. 22 and a second (expanded) position in which the base support 40 is positioned on the ground surface 17 such as a floor so as to support the body support 30 such as shown in FIG. 20. When in the first position, the base support 40 may be collapsed against the body support 30. When in the second position, the base support 40 may act as a stand for the body support 30 to retain the body support 30 above the ground surface 17 for use.

The base support 40 is generally pivoted toward the surface 16 when being moved into the first (collapsed) position and pivoted away from the surface 16 when being moved into the second (expanded) position. Thus, when the base support 40 is in the first position, it will be closer to the surface 16 than when in the second position.

The base support 40 is preferably pivotably connected to both the mount support 20 and the body support 30 such that the base support 40 may be folded upwardly into the first (collapsed) position to reduce the overall footprint of the wall-mounted collapsible exercise system 10. As best shown in FIG. 1A, the base support 40 may be pivotably connected at its upper end to the body support 30 and at its lower end to the mount support 20; with a pair of linkages 49*a*, 49*b* interconnecting the base support 40 and the mount support 20.

As shown throughout the figures, the base support 40 may comprise an upper member 41, a lower member 43, and a central member 45 extending between the upper and lower members 41, 43 to form an "I" shape. It should be appreciated that other configurations, shapes, and sizes may be utilized for the base support 40. The base support 40 may be pivoted upwardly into the first position or downwardly into the second position.

The upper member 41 of the base support 40 may be pivotably connected to the body support 30. In the exemplary embodiment shown in the figures, the upper member 41 of the base support 40 is illustrated as being pivotably connected to the second end member 33 of the body support 30. However, it should be appreciated that the manner in which the base support 40 is pivotably connected to the body support 30 may vary in different embodiments.

In the exemplary embodiment shown in FIG. 1A, the upper member 41 of the base support 40 comprises a pair of upper base connectors 42*a*, 42*b* which comprise brackets with pivot pins, though other configurations may be utilized. In the exemplary figures, the first upper base connector 42*a* is pivotably connected to the first side member 34 of the body support 30 and the second upper base connector 42*b* is pivotably connected to the second side member 35 of the body support 30.

The upper member 41 of the base support 40 may comprise a U-shaped configuration as shown in the figures, but the upper member 41 should not be construed as limited to a U-shaped configuration as various other configurations may be utilized in different embodiments. The central member 45 may be connected at or near the mid-point of the upper member 41 as shown in the figures, or at any other location along the length of the upper member 41. The central member 45 interconnects the upper member 41 with the lower member 43.

As best shown in FIGS. 1A and 1B, the lower member 43 of the base support 40 may be pivotably connected to the mount support 20. In the exemplary embodiment shown in the figures, the lower member 43 of the base support 40 is illustrated as being pivotably connected to the lower member 23 of the mount support 20 by a pair of linkages 49*a*, 49*b*. However, it should be appreciated that the manner in which the base support is pivotably connected to the mount support 20 may vary in different embodiments.

In the exemplary embodiment shown in FIG. 1A, the lower member 43 of the base support 40 comprises a pair of lower base connectors 44*a*, 44*b* which are each pivotably connected to a corresponding linkage 49*a*, 49*b*. In the exemplary figures, the first lower base connector 44*a* is pivotably connected to a first linkage 49*a* and the second lower base connector 44*b* is pivotably connected to a second linkage 49*b*.

The linkages 49*a*, 49*b* interconnect the base support 40 with the mount support 20 in a pivotable manner. As shown in FIG. 1A, a first end of each linkage 49*a*, 49*b* is pivotably connected to the lower member 23 of the mount support 20 by lower pivot connectors 26*a*, 26*b* and a second end of each linkage 49*a*, 49*b* is pivotably connected to the lower member 43 of the base support 40 by lower base connectors 44*a*, 44*b*.

More specifically, a first end of the first linkage 49*a* may be pivotably connected to the first lower pivot connector 26*a* of the mount support 20 and a second end of the first linkage 49*a* may be pivotably connected to the first lower base connector 44*a* of the base support 40. The first end of the second linkage 49*b* may be pivotably connected to the second lower pivot connector 26*b* of the mount support 20 and the second end of the second linkage 49*b* may be pivotably connected to the second lower base connector 44*b* of the base support 40.

Figure 2:
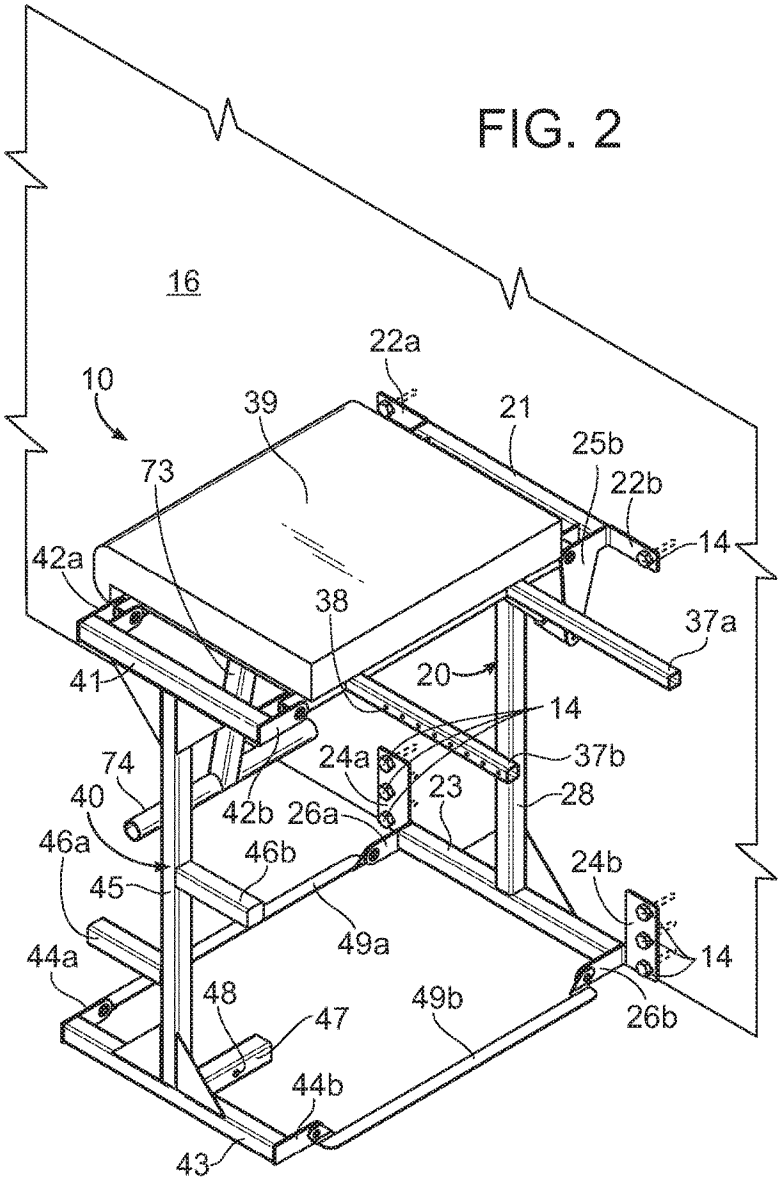
FIG. 2 is a perspective view of a wall-mounted collapsible exercise system secured against a wall in an expanded position in accordance with an example embodiment.
Figure 4:
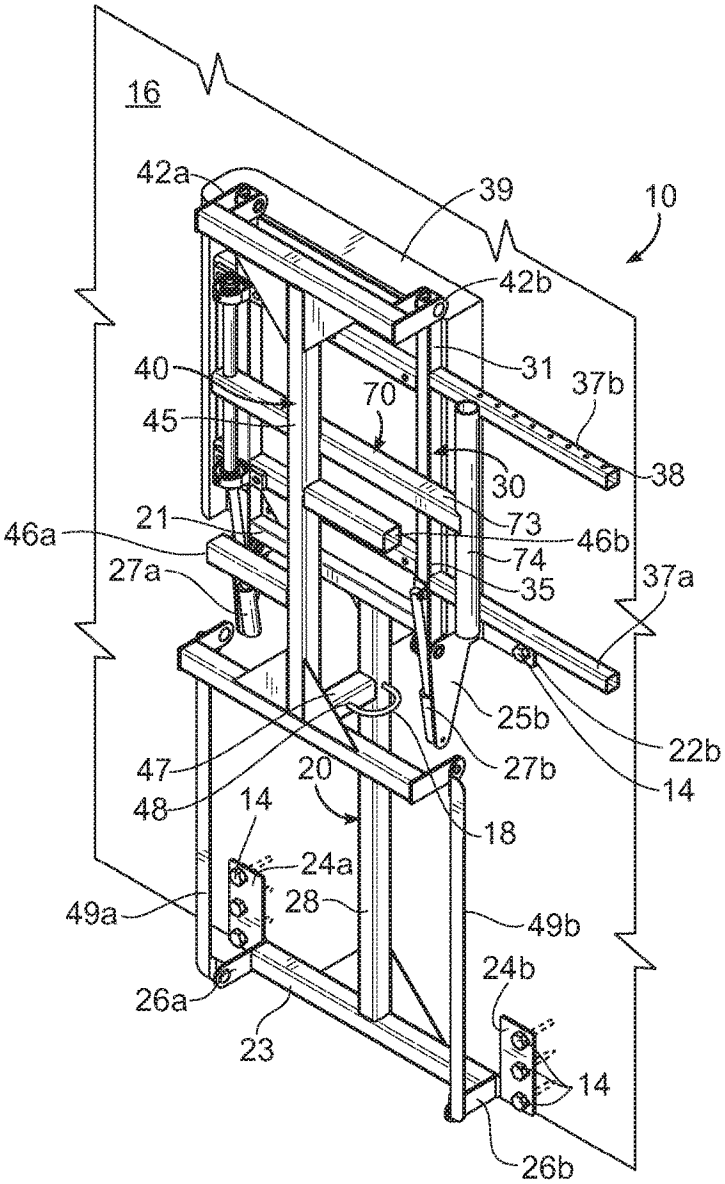
FIG. 4 is a perspective view of a wall-mounted collapsible exercise system secured against a wall in a collapsed position in accordance with an example embodiment.
Figure 6:
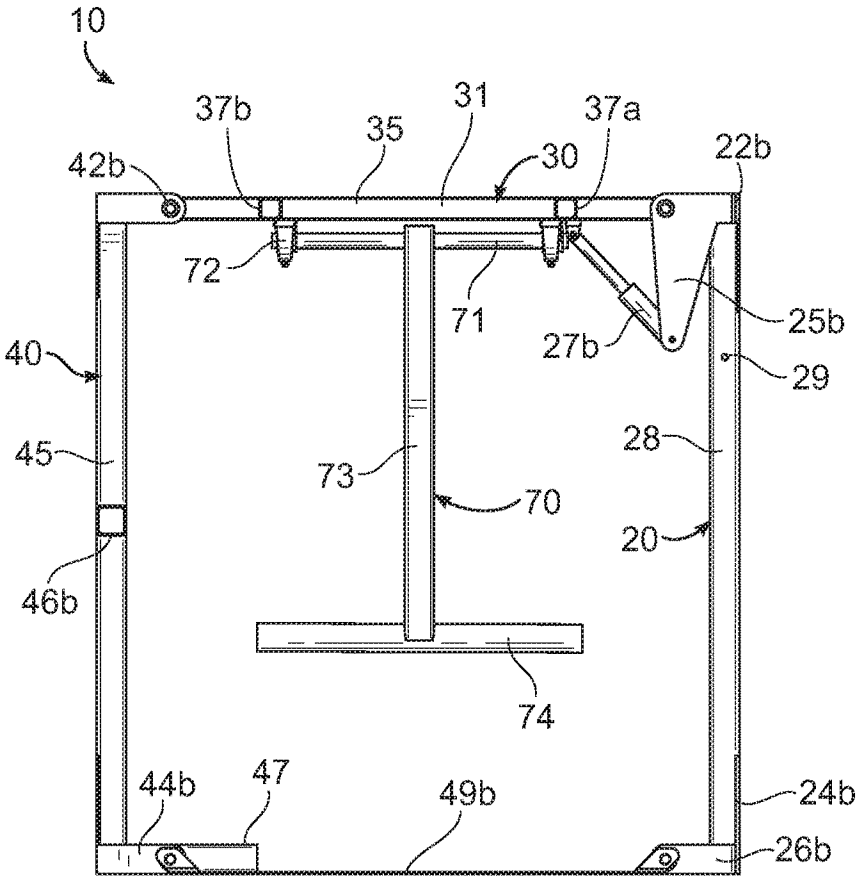
FIG. 6 is a first side view of a wall-mounted collapsible exercise system in an expanded position in accordance with an example embodiment.
Figure 5:
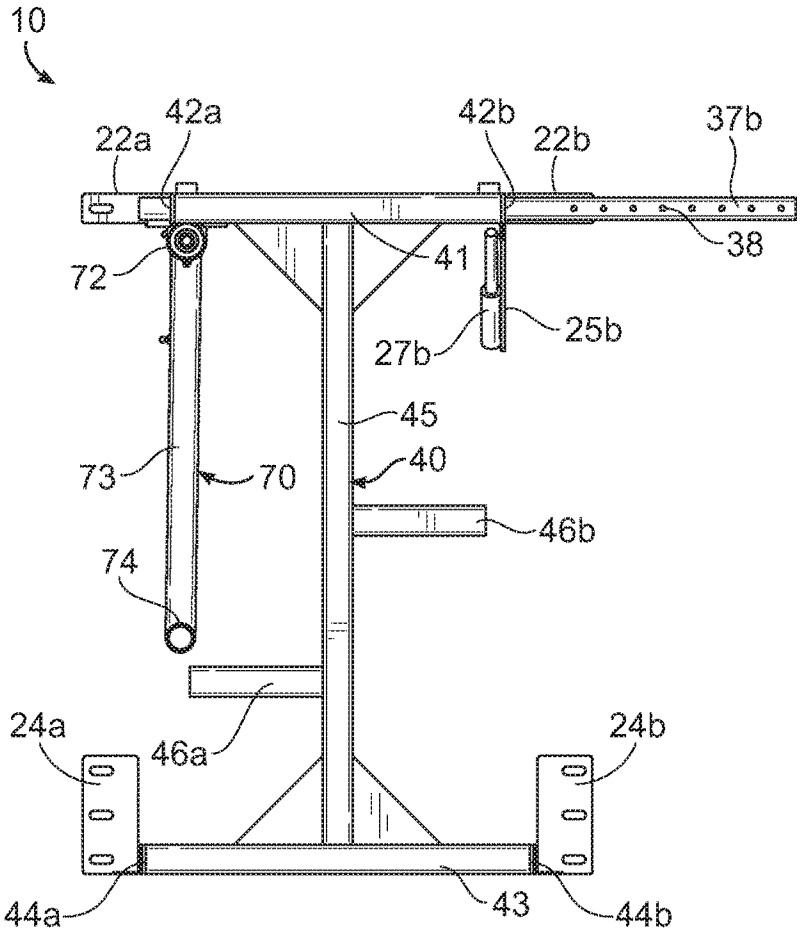
FIG. 5 is a first end view of a wall-mounted collapsible exercise system in an expanded position in accordance with an example embodiment.
Figure 8:
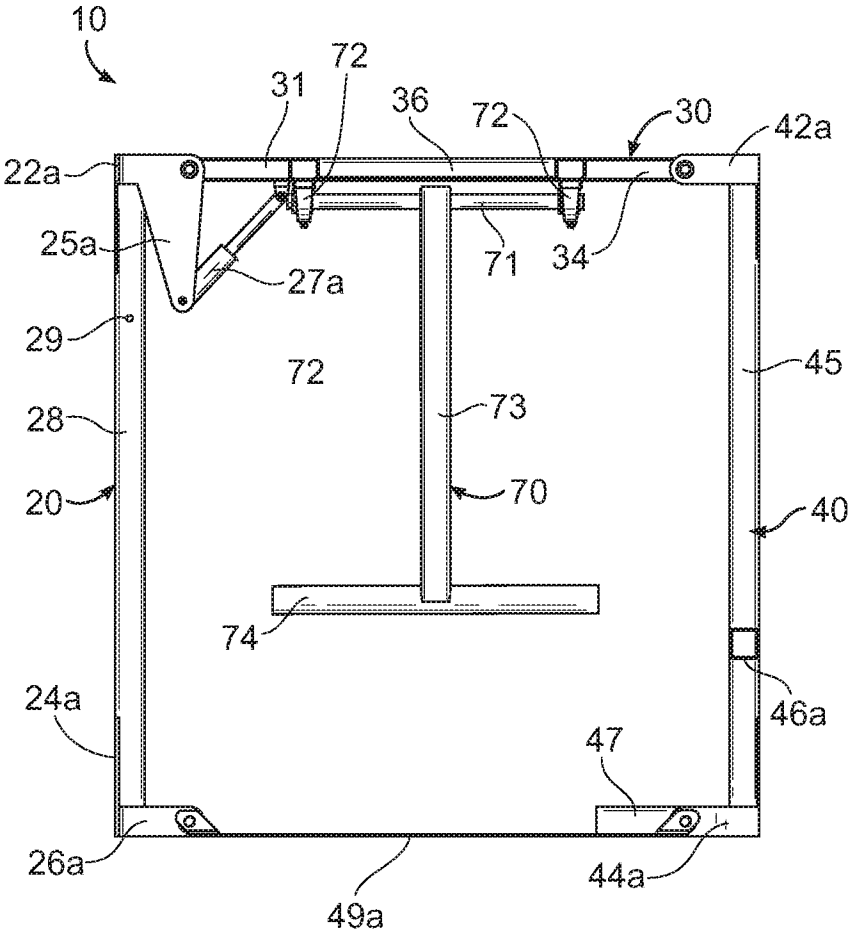
FIG. 8 is a second side view of a wall-mounted collapsible exercise system in an expanded position in accordance with an example embodiment.

When in the second (expanded) position, the linkages 49*a*, 49*b* may extend along the ground surface 17 perpendicular to the surface 16 such as shown in FIGS. 2, 11, and 20. When in the first (collapsed) position, the linkages 49*a*, 49*b* may extend along the surface 16 parallel to the surface 16 such as shown in FIGS. 4, 16, and 22. The linkages 49*a*, 49*b* are illustrated in the exemplary figures as comprising flattened elongated members. The linkages 49*a*, 49*b* may comprise various types of elongated members, including beams, rods, posts, poles, and the like. The linkages 49*a*, 49*b* may in some embodiments be semi-rigid or flexible.

As best shown in FIG. 1A, the base support 40 may comprise one or more steps 46*a*, 46*b* which aid an exercise 12 within mounting or dismounting the body support 30. In the exemplary embodiment of the figures, the base support 40 is illustrated as comprising a first step 46*a* extending in a first direction and a second step 46*b* extending in a second direction opposite to the first.

The steps 46*a*, 46*b* may comprise elongated members extending outwardly from the central member 45 as shown in the figures, or may comprise other configurations. The number of steps 46*a*, 46*b* may vary in different embodiments, with a single step 46*a* being utilized in some embodiments and three or more steps 46*a*, 46*b* being utilized in other embodiments. The size, shape, and number of steps 46*a*, 46*b* should not be construed as limited by the exemplary figures.

As best shown in FIG. 16, the base support 40 may comprise a connector member 47 which allows the base support 40 to be removably connected to the mount support 20. The connector member 47 may comprise an elongated member extending inwardly from the base support 40, such as from the central member 45 as shown in FIG. 16.

When in the first (collapsed) position, the connector member 47 may rest against the central member 28 of the mount support 20. The connector member 47 may also serve as a spacer to keep the body support 30 spaced-apart from the surface 16 when in the first (collapsed) position, such as to make room for the pad 39 as shown in FIG. 22.

The connector member 47 may comprise a connector opening 48 which is adapted to receive a locking member 18 to connect the base support 40 to the mount support 20 when in the first (collapsed) position. The locking member 18 may be connected between the mount support 20 and the base support 40 to retain the base support 40 in an upward orientation when collapsed. More specifically, the locking member 18 may be connected between the connector member 47 of the base support 40 and the central member 28 of the mount support 20 such as shown in FIG. 16.

The locking member 18 may comprise various fasteners, bolts, and the like. In the exemplary figures, the locking member 18 is illustrated as comprising a U-bolt which engages with both the opening 29 of the central member 28 of the mount support 20 and the connector opening 48 of the connector member 47 of the base support 40. The U-bolt may be inserted into the openings 29, 48 to secure the base support 40 against the mount support 20 when collapsed and removed from the opening 29, 48 to release the base support 40 from the mount support 20 when expanded for use.

E. Glute Ham Developer (GHD) Configuration.

The body support 30 may be converted between various exercise configurations when the body support 30 is lowered into the second position for use by an exerciser 12. As shown in FIGS. 24-32, the body support 30 may be converted to a glute ham developer (GHD) configuration 50 through use of a roller assembly 55.

Figure 31:
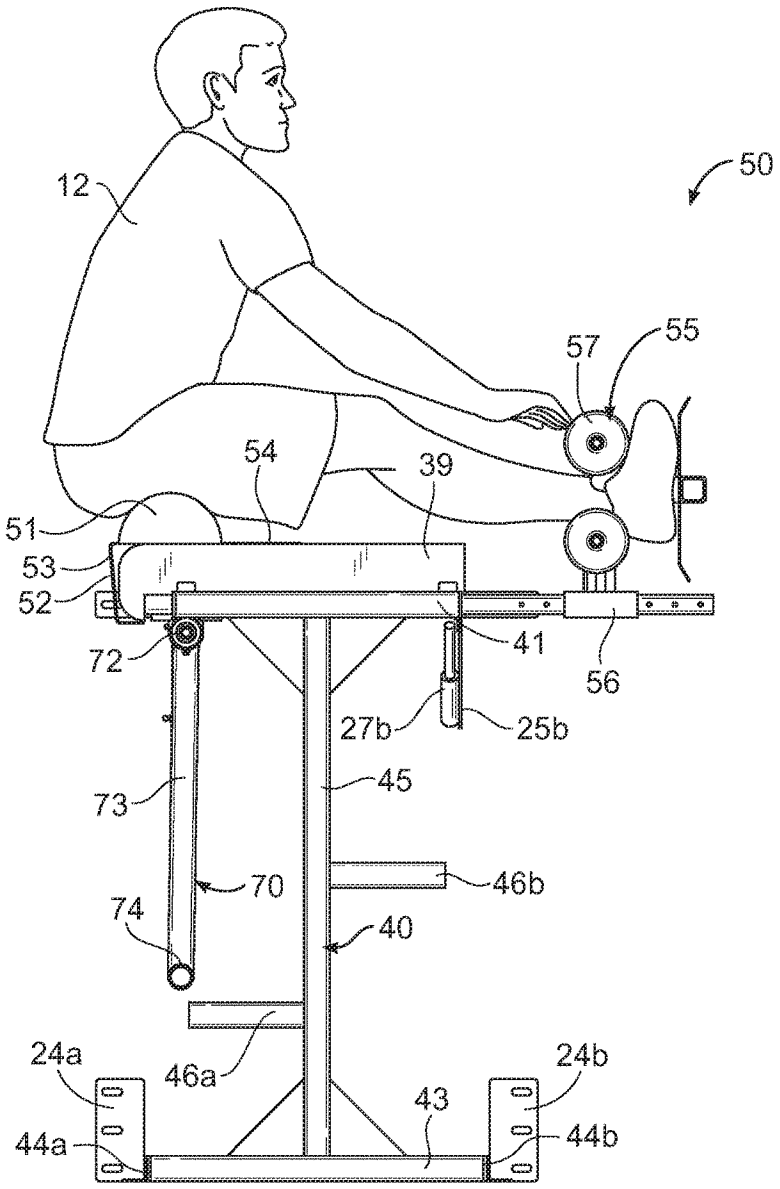
FIG. 31 is an end view of a wall-mounted collapsible exercise system in an expanded position configured to function as a glute ham developer in use in a first manner in accordance with an example embodiment.
Figure 32:
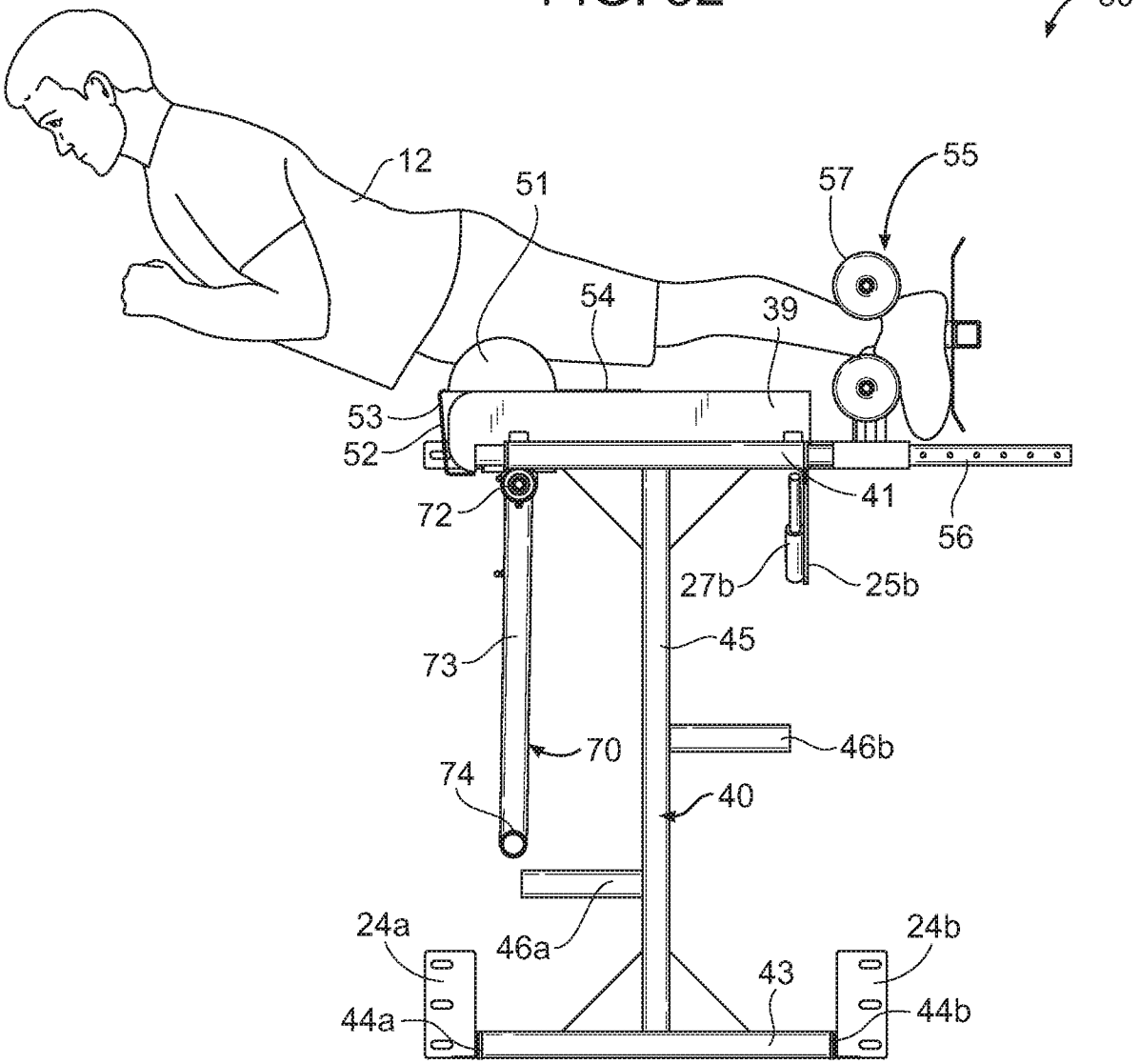
FIG. 32 is an end view of a wall-mounted collapsible exercise system in an expanded position configured to function as a glute ham developer in use in a second manner in accordance with an example embodiment.

In the GHD configuration 50, the body support 30 may serve as a glute ham developer as is known in the art. Support pads 51 may be removably connected to the body support 30 such as shown in FIG. 24. Although the figures illustrate the use of a pair of support pads 51, it should be appreciated that more or less support pads 51 may be utilized in different embodiments. Generally, the supports pad 51 will be removably connected on top of the pad 39 if present on the body support 30. The support pads 51 aid in supporting the body of the exerciser 12 when performing glute ham exercises such as shown in FIGS. 31 and 32.

As best shown in FIG. 23, the support pads 51 may include a support pad bracket 52 for removably connecting the support pads 51 to the body support 30. The support pad bracket 52 may comprise a base 54 and a pair of flange connectors 53 which extends downwardly from the base 54. The base 54 may comprise a plate such as shown in the figures which rests on the body support 30 or pad 39.

The flange connector 53 may be adapted to engage around the body support 30 such as shown in FIG. 24. In the exemplary embodiment of the figures, a pair of flange connectors 53 is utilized to removably secure the support pads 51 to the body support 30. When in position, the base 54 of the support pad bracket 52 rests on the body support 30 while the flange connectors 53 extend around the body support 30 to retain the support pad bracket 52 and support pads 51 on the body support 30 for use. The support pads 51 may be fixedly or removably connected to the support pad bracket 52 in different embodiments.

In some embodiments, a strap, rope, or the like (not shown) may be utilized to retain the support pad 51 tightly against the body support 30 or pad 39. Such a strap may be attached at various locations between the support pad 51 and the body support 30. By way of example, such a strap could be attached to the flange connector 53 and either the roller assembly 55 or the attachment mounts 37*a*, 37*b*, or any other structure which will prevent the support pad 51 from moving or sliding (such as forward) during use.

As best shown in FIG. 24, the GHD configuration 60 may include a roller assembly 55 which is adapted to be removably connected to the body support 30. In the exemplary embodiment shown in the figures, the roller assembly 55 is illustrated as comprising a plurality of rollers 57 through which an exerciser 12 may secure his or her feet, shins, or legs as is typical with a glute ham developer.

The roller assembly 55 may be removably connected to the attachment mounts 37*a*, 37*b* of the body support 30 such as shown in FIG. 24. The roller assembly 55 may comprise a roller mount 56 which fits over the attachment mounts 37*a*, 37*b*. The roller mount 56 may be secured at various locations along the length of the attachment mounts 37*a*, 37*b* through use of a fastener and the attachment openings 38 of the attachment mounts 37*a*, 37*b*. Thus, the positioning of the roller assembly 55 with respect to the body support 30 may be varied to suit the needs of each exerciser 12.

F. Reverse Hyper Extension Machine Configuration.

As best shown in FIGS. 11-15, the body support 30 may be converted to a reverse hyper configuration 60 to act as a reverse hyper extension machine through use of a handle assembly 62 in combination with the swing arm 70. When in the reverse hyper configuration 60, the body support 30 may function as a reverse hyper extension machine as is known in the art. An exerciser 12 may rest his or her body against the body support 30, grasp the handle assembly 62, and lift and lower the swing arm 70 with his or her legs or feet such as shown in FIG. 15.

A handle assembly 62 may be removably connected to the attachment mounts 37*a*, 37*b* of the body support 30 to convert the body support 30 to the reverse hyper configuration 60 such as shown in FIG. 11. The handle assembly 62 may comprise a pair of handles 63*a*, 63*b* which are linked by a handle connector 64. The handle connector 64 may fit over the attachment mounts 37*a*, 37*b* of the body support 30 such as shown in FIG. 11.

The handle assembly 62 may be secured at various locations along the length of the attachment mounts 37*a*, 37*b* through use of a fastener and the attachment openings 38 of the attachment mounts 37*a*, 37*b*. Thus, the positioning of the handle assembly 62 with respect to the body support 30 may be varied to suit the needs of each exerciser 12.

G. Operation of Preferred Embodiment.

Figure 3:
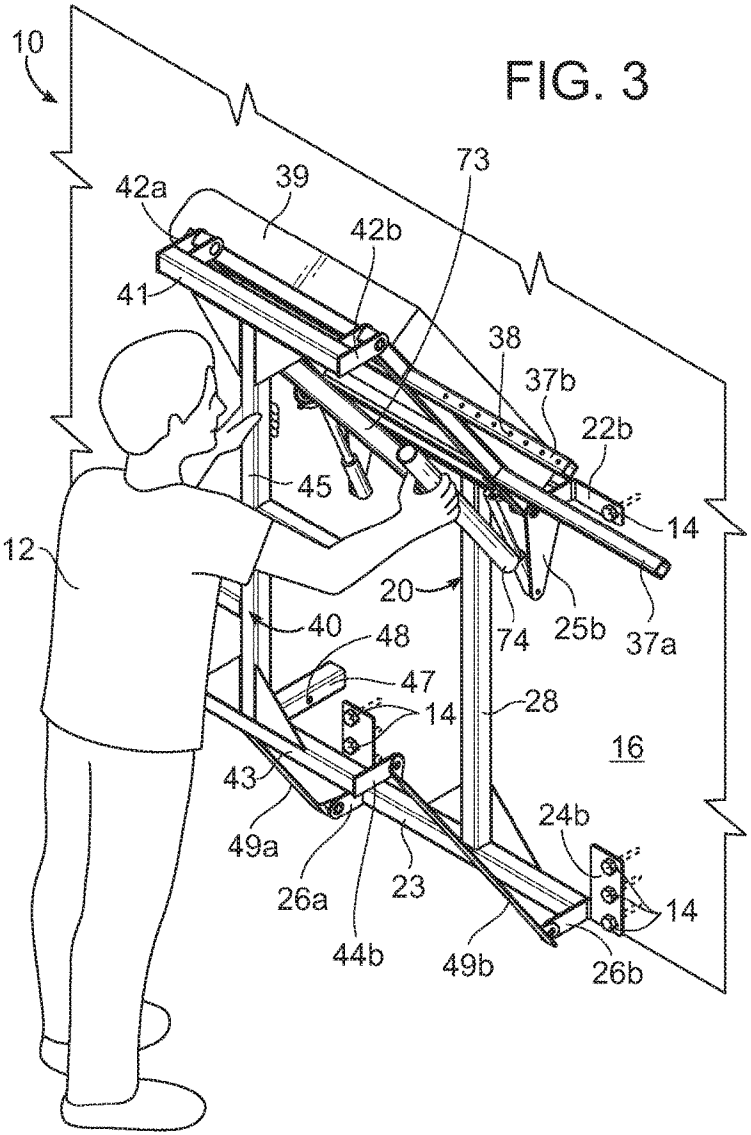
FIG. 3 is a perspective view of a wall-mounted collapsible exercise system being adjusted between the expanded and collapsed position in accordance with an example embodiment.
Figure 21:
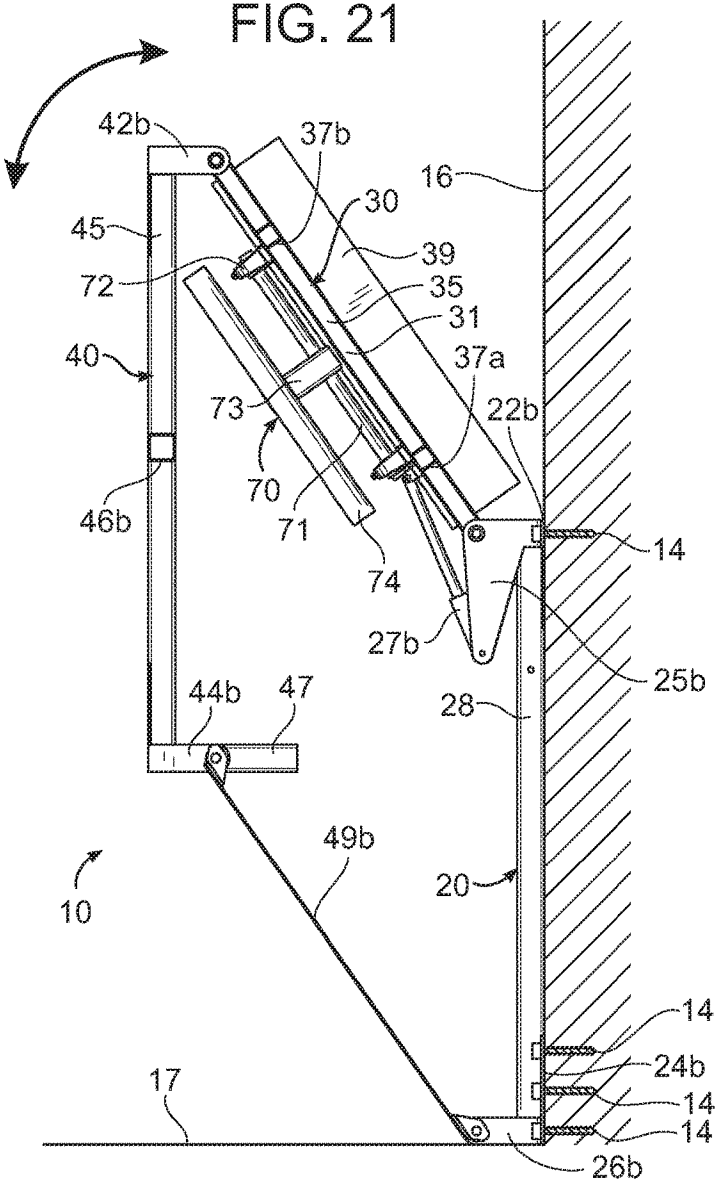
FIG. 21 is a side view of a wall-mounted collapsible exercise system transitioning between expanded and collapsed states in accordance with an example embodiment.

In use, the wall-mounted collapsible exercise system 10 may be adjustable between at least two positions: a first position in which the wall-mounted collapsible exercise system 10 is collapsed against a surface 16 such as a wall as shown in FIGS. 4, 16, and 22 and a second position in which the wall-mounted collapsible exercise system 10 is expanded for use such as shown in FIGS. 2 and 20. FIGS. 3 and 21 illustrate the wall-mounted collapsible exercise system 10 being adjusted between the first and second positions (or vice versa).

When in the first position for compact storage, the footprint of the wall-mounted collapsible exercise system 10 will be minimized to save space. When in the second position, the wall-mounted collapsible exercise system 10 may be convertible between various exercise configurations to function as various exercise machines, including a glute ham developer configuration 50 as shown in FIG. 24 and a reverse hyper extension machine configuration 60 as shown in FIG. 15.

To initially install the wall-mounted collapsible exercise system 10, the mount support 20 will generally first be connected to a surface 16 such as a wall. The mount support 20 may first be positioned against the surface 16; with the upper member 21 and lower member 23 of the mount support 20 being positioned against the surface 16. The upper brackets 22*a*, 22*b* and lower brackets 24*a*, 24*b* may be connected to the surface 16, such as with fasteners 14 as shown in FIGS. 20-22. With the mount support 20 secured against the surface 16, the wall-mounted collapsible exercise system 10 may be ready for use.

As shown throughout the figures, the body support 30 and base support 40 may be pivoted upwardly and secured against the mount support 20 to collapse the wall-mounted collapsible exercise system 10 into the first position. The first position is useful for saving space when the wall-mounted collapsible exercise system 10 is not in use.

To collapse the wall-mounted collapsible exercise system 10, an exercise 12 may first pivot the body support 30 and base support 40 upwardly about a horizontal axis running parallel to the ground surface 17. It should be appreciated that the body support 30 and base support 40 may pivot about other axes in different embodiments. The linkages 49*a*, 49*b* similarly pivot; with the first ends of the linkages 49*a*, 49*b* pivoting with respect to the mount support 20 and the second ends of the linkages 49*a*, 49*b* pivoting with respect to the base support 40.

The manner in which the body support 30 and base support 40 are pivoted upwardly may vary in different embodiments. In an exemplary embodiment, an exerciser 12 may grasp the body support 30 or the base support 40 and push upwardly such as shown in FIG. 3; causing the body support 30 to pivot with respect to the mount support 20 and the base support 40 to pivot with respect to the body support 30. In one embodiment, an exerciser 12 may grasp the central member 45 of the base support 40 which may function as a handle as shown in FIG. 3. The exerciser 12 may grasp the swing arm 70 and rotate it out of the way when collapsing the body support 30.

In other exemplary embodiments, actuators 27*a*, 27*b* may be utilized to either assist the exerciser 12 or to perform all of the work in raising the body support 30 and base support 40 into the first position. Actuators 27*a*, 27*b* such as pneumatic actuators may be utilized to provide assistance to the exerciser 12 so that less force is required to adjust the body and base supports 30, 40. In other embodiments, the actuators 27*a*, 27*b* may be activated without outside force from the exerciser 12 to raise the body and base supports 30, 40. In some embodiments, a remote control or mobile device such as a smart phone may be utilized to extend the actuators 27*a*, 27*b* to raise the body and base supports 30, 40.

FIGS. 4 and 22 illustrate the body support 30 and base support 40 pivoted into the first position to be collapsed against the mount support 20 as surface 16. As can be seen, the swing arm 70 has been pivoted to the side as shown in FIG. 3 and is sandwiched and secured between the base support 40 and the body support 30. The body support 30 and base support 40 are collapsed against each other at a position above the mount support 20 against the surface 16. In this manner, the space taken up by the wall-mounted collapsible exercise system 10 may be significantly reduced when it is not in use.

The body support 30 and the base support 40 may be secured in the collapsed position in various manners. In some embodiments, the actuators 27*a*, 27*b* may function to retain the body and base supports 30, 40 in their raised positions. In other embodiments, a locking member 18 such as a U-bolt or other type of fastener may be utilized. In such embodiments, the base support 40 may be secured against the mount support 20 when in the raised position.

The base support 40 may include a connector member 47 having a connector opening 48 and the mount support 20 may include a central member 28 having an opening 29. The locking member 18 may be connected between the connector opening 48 of the base support 40 and the opening 29 of the mount support 20 to secure the body and base supports 30, 40 in the raised position such as shown in FIGS. 4 and 16.

When ready for use exercising, the body and base supports 30, 40 may be pivoted downwardly into the second (expanded) position such as shown in FIG. 20. In this position, the body support 30 is supported in a perpendicular orientation with respect to the surface 16 above the ground by the base support 40, which acts as a stand or leg for the body support 30. The body support 30 may then be used by the exerciser 12 to perform various types of exercises.

To lower the body and base supports 30, 40, the locking member 18 (if used) may be disengaged from between the mount support 20 and base support 40 to release the base support 40 and the body support 30. An exercise 12 may grasp the base support 40, such as its upper member 41, and pull downwardly to pivot the base support 40 and body support 30 downwardly into the second position. The actuators 27*a*, 27*b* may assist with reducing force required by the exerciser 12, or may act by themselves to perform the adjustment; such as by remote control or the like.

The body support 30 will pivot downwardly until it is supported by the base support 40, which rests against the ground surface 17. More specifically, the body support 30 will pivot with respect to the mount support 20 and the base support 40 will pivot with respect to the body support 30. The linkages 49*a*, 49*b* will pivot at their first ends with respect to the mount support 20 and at their second ends with respect to the base support 40. The swing arm 70 will swing downwardly to be ready for use.

FIGS. 1A and 1B illustrate the body and base supports 30, 40 lowered into the second position for use. When in the second position, various exercise attachments may be utilized to allow the body support 30 to function as various types of exercise machines. By way of example, the body support 30 may function as a glute ham developer in a glute ham developer configuration 50 or as a reverse hyper extension machine in a reverse hyper configuration 60.

To convert to the GHD configuration 50, support pads 51 may be connected to the body support 30. The support pad bracket 52 may be secured onto the pad 39 of the body support 30; with the base 54 of the support pad bracket 52 resting against the pad 39 and the flange connector 53 of the support pad bracket 52 extending around the pad 39 and body support 30 such as shown in FIG. 24. A roller assembly 55 may be secured to the attachment mounts 37*a*, 37*b* which extend from the body support 30. The positioning of the roller assembly 55 may be variably selected using the attachment openings 38 of the attachment mounts 37*a*, 37*b*.

With the support pads 51 and roller assembly 55 secured, the body support 30 may be utilized for glute ham development. The exerciser 12 may position him or herself on the body support 30 and extend his or her legs through the roller assembly 55. FIG. 31 illustrates an exerciser 12 seated on the body support 30 with legs extending through the roller assembly 55. FIG. 32 illustrates an exerciser 12 lying across the body support 30 with legs extending through the roller assembly 55. The legs may be lifted and lowered to perform exercises. It should be appreciated that these are merely exemplary methods of utilizing the GHD configuration 50 and should not be construed as limiting in scope.

To convert to the reverse hyper configuration 60, the handle assembly 62 may be connected to the attachment mounts 37*a*, 37*b* of the body support 30 such as shown in FIG. 11. The positioning of the handle assembly 62 may be variably selected using the attachment openings 38 of the attachment mounts 37*a*, 37*b*.

With the handle assembly 62 connected to the body support 30, weights 75 may be optionally added to the weight supports 74 of the swing arm 70. In some embodiments, the swing arm 70 may be utilized without weights 75 for minimal resistance. A strap 76 may be connected to the swing arm 70 such that the exerciser 12 may place his or her feet or legs within the strap 76 to raise or lower the swing arm 70. FIG. 15 illustrates an exerciser 12 with his feet within the strap 76 to raise and lower the weighted swing arm 70 to perform exercises. As can be seen, the exerciser 12 is grasping the handles 63*a*, 63*b* with his body resting on the body support 30. This is not meant to be limiting, as various other methods of exercising may be performed when in the reverse hyper configuration 60.

Unless otherwise defined, all technical and scientific terms used herein have the same meaning as commonly understood by one of ordinary skill in the art to which this invention belongs. Although methods and materials similar to or equivalent to those described herein can be used in the practice or testing of the wall-mounted collapsible exercise system, suitable methods and materials are described above. All publications, patent applications, patents, and other references mentioned herein are incorporated by reference in their entirety to the extent allowed by applicable law and regulations. The wall-mounted collapsible exercise system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A wall-mounted collapsible exercise system, comprising:

a mount support adapted to be connected to a wall;

a body support pivotably connected to the mount support such that the body support pivots with respect to the mount support, wherein the body support comprises an outer end and an inner end, wherein the inner end of the body support is pivotably connected to the mount support;

a base support pivotably connected to the body support such that the base support pivots with respect to the body support, wherein the base support comprises an upper member, a lower member, and a central member, wherein the upper member of the base support is pivotably connected to the outer end of the body support;

wherein the body support and the base support are pivotable between a first position and a second position, wherein in the first position the base support and the body support are collapsed against the mount support, wherein in the second position the body support extends outwardly from the wall at a perpendicular orientation with respect to the wall;

a swing arm pivotably connected to the body support, the swing arm being adapted to receive a weight; and an attachment mount connected to the body support, the attachment mount being adapted to receive one or more exercise attachments.

2. The wall-mounted collapsible exercise system of claim 1, wherein the base support comprises a connector member extending inwardly from the central member of the base support.

3. The wall-mounted collapsible exercise system of claim 2, wherein the connector member is adapted to be connected to the mount support when the base support is in the first position.

4. The wall-mounted collapsible exercise system of claim 3, comprising a locking member adapted to removably connect the connector member and the mount support when the base support is in the first position.

5. The wall-mounted collapsible exercise system of claim 1, wherein the mount support comprises an upper member and a lower member, wherein the upper member and the lower member are each connected to the wall.

6. The wall-mounted collapsible exercise system of claim 5, wherein the body support is pivotably connected to the upper member of the mount support.

7. The wall-mounted collapsible exercise system of claim 1, comprising an actuator connected between the mount support and the body support, the actuator being adapted to adjust the body support between the first position and the second position.

8. The wall-mounted collapsible exercise system of claim 1, wherein the one or more exercise attachments comprises a roller assembly, wherein the roller assembly is removably connected to the attachment mount to form a glute ham developer configuration.

9. The wall-mounted collapsible exercise system of claim 1, comprising one or more steps connected to the base support.

10. The wall-mounted collapsible exercise system of claim 1, comprising a linkage pivotably connected at a first end of the linkage to the mount support and at a second end of the linkage to the base support.

11. A wall-mounted collapsible exercise system, comprising:

a mount support adapted to be connected to a wall, wherein the mount support comprises an upper member and a lower member, the upper member and the lower member each being connected to the wall;

a body support pivotably connected to the upper member of the mount support, wherein the body support comprises an outer end and an inner end, wherein the inner end of the body support is pivotably connected to the mount support;

a base support pivotably connected to the outer end of the body support such that the base support pivots with respect to the body support, wherein the base support comprises an upper end and a lower end;

a linkage pivotably connected at a first end to the lower member of the mount support and at a second end to the lower end of the base support;

wherein the body support and the base support are pivotable between a first position and a second position, wherein in the first position the body support extends along the wall at a parallel orientation with respect to the wall, wherein in the second position the body support extends outwardly from the wall at a perpendicular orientation with respect to the wall;

wherein in the first position the base support is positioned against the body support at a parallel orientation with respect to the wall, wherein in the second position the lower end of the base support is positioned on a ground surface;

wherein in the second position the body support is adapted to be converted between a glute ham developer configuration and a reverse hyper configuration;

a swing arm pivotably connected to the body support, the swing arm being adapted to receive a weight; and an attachment mount connected to the body support, the attachment mount being adapted to receive one or more exercise attachments to convert the body support between the glute ham developer configuration and the reverse hyper configuration.

12. The wall-mounted collapsible exercise system of claim 11, wherein the one or more exercise attachments comprise a roller assembly removably connected to the attachment mount when in the glute ham developer configuration.

13. The wall-mounted collapsible exercise system of claim 12, wherein the one or more exercise attachments comprise a handle assembly removably connected to the attachment mount when in the reverse hyper configuration.

14. The wall-mounted collapsible exercise system of claim 11, comprising a support pad adapted to be removably connected to the body support.

15. The wall-mounted collapsible exercise system of claim 14, comprising a support pad bracket for removably connecting the support pad to the body support.

16. The wall-mounted collapsible exercise system of claim 11, comprising an actuator connected between the mount support and the body support.

17. A wall-mounted collapsible exercise system, comprising:

a mount support adapted to be connected to a wall;

a body support pivotably connected to the mount support such that the body support pivots with respect to the mount support, wherein the body support comprises an outer end and an inner end, wherein the inner end of the body support is pivotably connected to the mount support;

a base support pivotably connected to the body support such that the base support pivots with respect to the body support;

wherein the body support and the base support are pivotable between a first position and a second position, wherein in the first position the base support and the body support are collapsed against the mount support, wherein in the second position the body support extends outwardly from the wall at a perpendicular orientation with respect to the wall;

a swing arm pivotably connected to the body support, the swing arm being adapted to receive a weight;

an actuator connected between the mount support and the body support, the actuator being adapted to adjust the body support between the first position and the second position; and an attachment mount connected to the body support, the attachment mount being adapted to receive one or more exercise attachments.

18. The wall-mounted collapsible exercise system of claim 17, wherein the actuator comprises a pneumatic actuator.

19. A wall-mounted collapsible exercise system, comprising:

a mount support adapted to be connected to a wall;

a body support pivotably connected to the mount support such that the body support pivots with respect to the mount support, wherein the body support comprises an outer end and an inner end, wherein the inner end of the body support is pivotably connected to the mount support;

a base support pivotably connected to the body support such that the base support pivots with respect to the body support;

wherein the body support and the base support are pivotable between a first position and a second position, wherein in the first position the base support and the body support are collapsed against the mount support, wherein in the second position the body support extends outwardly from the wall at a perpendicular orientation with respect to the wall;

a swing arm pivotably connected to the body support, the swing arm being adapted to receive a weight; and an attachment mount connected to the body support, the attachment mount being adapted to receive one or more exercise attachments, wherein the one or more exercise attachments comprises a roller assembly, wherein the roller assembly is removably connected to the attachment mount to form a glute ham developer configuration.

20. The wall-mount collapsible exercise system of claim 19, wherein the one or more exercise attachments further comprise a handle assembly, wherein the handle assembly is removably connected to the attachment mount to form a reverse hyper configuration.

21. A wall-mounted collapsible exercise system, comprising:

a mount support adapted to be connected to a wall;

a body support pivotably connected to the mount support such that the body support pivots with respect to the mount support, wherein the body support comprises an outer end and an inner end, wherein the inner end of the body support is pivotably connected to the mount support;

a base support pivotably connected to the body support such that the base support pivots with respect to the body support;

one or more steps connected to the base support;

wherein the body support and the base support are pivotable between a first position and a second position, wherein in the first position the base support and the body support are collapsed against the mount support, wherein in the second position the body support extends outwardly from the wall at a perpendicular orientation with respect to the wall;

a swing arm pivotably connected to the body support, the swing arm being adapted to receive a weight; and an attachment mount connected to the body support, the attachment mount being adapted to receive one or more exercise attachments.

* * * * *